US011668310B2

(12) United States Patent
Huang et al.

(10) Patent No.: US 11,668,310 B2
(45) Date of Patent: Jun. 6, 2023

(54) MULTICHANNEL AIR PUMP

(71) Applicant: Intex Marketing Ltd., Fujian (CN)

(72) Inventors: Zhi Xiong Huang, Fujian (CN); Huai Tian Wang, Fujian (CN); Yaw Yuan Hsu, Fujian (CN)

(73) Assignee: Intex Marketing Ltd., Tortola (VG)

( * ) Notice: Subject to any disclaimer, the term of this patent is extended or adjusted under 35 U.S.C. 154(b) by 0 days.

(21) Appl. No.: 16/764,583

(22) PCT Filed: Nov. 15, 2018

(86) PCT No.: PCT/IB2018/059009
§ 371 (c)(1),
(2) Date: May 15, 2020

(87) PCT Pub. No.: WO2019/097453
PCT Pub. Date: May 23, 2019

(65) Prior Publication Data

US 2020/0386237 A1 Dec. 10, 2020

(30) Foreign Application Priority Data

Nov. 15, 2017 (CN) ..... 201711129250.5
Nov. 15, 2017 (CN) ..... 201721523732.4
May 16, 2018 (CN) ..... 201820730684.4

(51) Int. Cl.
*F04D 25/08* (2006.01)
*F04D 27/00* (2006.01)
(Continued)

(52) U.S. Cl.
CPC ..... *F04D 25/08* (2013.01); *A47C 27/081* (2013.01); *A47C 27/082* (2013.01);
(Continued)

(58) Field of Classification Search
CPC ..... F04D 25/084; F04D 29/503; F04D 25/08; F04D 25/0673; F04D 27/005;
(Continued)

(56) References Cited

U.S. PATENT DOCUMENTS 388,037 A 8/1888 Hargin
1,198,687 A 9/1916 Williams et al.
(Continued)

FOREIGN PATENT DOCUMENTS

CN 1490529 A 4/2004
CN 2611641 Y 4/2004
(Continued)

OTHER PUBLICATIONS

International Preliminary Report on Patentability received for PCT Patent Application No. PCT/IB2018/059009, dated May 28, 2020, 8 pgaes.
(Continued)

*Primary Examiner* — Peter J Bertheaud
(74) *Attorney, Agent, or Firm* — Faegre Drinker Biddle & Reath LLP

(57) ABSTRACT

A multichannel air assembly (1000) for use with inflatable products with multiple inflatable chambers (C). Specifically, said multi-channel air assembly (1000) may be used to selectively inflate or deflate one or more chambers (C) of an inflatable product to varying pressures.

33 Claims, 32 Drawing Sheets

(51) Int. Cl.

| | |
|---|---|
| ***F04D 29/053*** | (2006.01) |
| ***F04D 29/26*** | (2006.01) |
| ***F04D 29/40*** | (2006.01) |
| ***F04D 29/50*** | (2006.01) |
| ***A47C 27/10*** | (2006.01) |
| ***A47C 27/08*** | (2006.01) |

(52) U.S. Cl.
CPC ..... *A47C 27/083* (2013.01); *A47C 27/10* (2013.01); *F04D 25/084* (2013.01); *F04D 27/005* (2013.01); *F04D 29/053* (2013.01); *F04D 29/266* (2013.01); *F04D 29/403* (2013.01); *F04D 29/503* (2013.01)

(58) Field of Classification Search
CPC .... F04D 29/053; F04D 29/266; F04D 29/403; A47C 27/082; A47C 27/083; A47C 27/10; A47C 27/081
See application file for complete search history.

(56) References Cited

U.S. PATENT DOCUMENTS 2,684,860 A 7/1954 Rafferty
2,926,836 A 3/1960 Oliver et al.
3,155,991 A 11/1964 Dunham
3,185,503 A 5/1965 Angle
3,388,701 A 6/1968 Peter et al.
3,596,936 A 8/1971 Dieckmann et al.
3,876,234 A 4/1975 Harms
4,193,149 A 3/1980 Welch
4,504,989 A 3/1985 Maltz
4,583,255 A 4/1986 Mogaki et al.
4,619,481 A 10/1986 Grudzinskas
4,638,519 A 1/1987 Hess
4,644,597 A 2/1987 Walker
4,711,275 A 12/1987 Ford et al.
4,768,249 A 9/1988 Goodwin
4,829,616 A 5/1989 Walker
4,890,344 A * 1/1990 Walker ..... A47C 27/083 5/713
4,897,890 A 2/1990 Walker
4,944,060 A 7/1990 Peery et al.
5,009,252 A 4/1991 Faughn
5,020,176 A 6/1991 Dotson
5,023,967 A 6/1991 Ferrand
5,044,029 A 9/1991 Vrzalik
5,138,729 A 8/1992 Ferrand
5,142,717 A 9/1992 Everard et al.
5,189,742 A 3/1993 Schild
5,235,713 A 8/1993 Guthrie et al.
5,249,319 A 10/1993 Higgs
5,279,010 A 1/1994 Ferrand et al.
5,323,500 A 6/1994 Roe et al.
5,345,629 A 9/1994 Ferrand
5,349,983 A 9/1994 Ozarowski et al.
5,354,117 A 10/1994 Danielson et al.
5,367,726 A 11/1994 Chaffee
5,509,154 A 4/1996 Shafer et al.
5,588,811 A 12/1996 Price
5,606,756 A 3/1997 Price
5,652,484 A 7/1997 Shafer et al.
5,711,041 A 1/1998 Chen
5,716,199 A 2/1998 Shan-Chieh
5,802,640 A 9/1998 Ferrand et al.
5,898,958 A 5/1999 Hall
5,903,941 A 5/1999 Shafer et al.
5,904,172 A 5/1999 Gifft et al.
5,906,016 A 5/1999 Ferrand et al.
5,906,017 A 5/1999 Ferrand et al.
5,944,494 A 8/1999 Soltani et al.
5,970,550 A 10/1999 Gazes
6,032,080 A 2/2000 Brisbane et al.
6,037,723 A 3/2000 Shafer et al.
6,058,537 A 5/2000 Larson
6,120,264 A 9/2000 Wang
6,152,176 A 11/2000 Lin
6,158,082 A 12/2000 Beckey et al.
6,185,770 B1 2/2001 Wang
6,206,654 B1 3/2001 Cassidy
6,212,718 B1 4/2001 Stolpmann et al.
6,219,868 B1 4/2001 Wang
6,253,401 B1 7/2001 Boyd
6,266,833 B1 7/2001 Lin
6,332,760 B1 12/2001 Chung
6,457,197 B1 10/2002 Wu
6,483,264 B1 11/2002 Shafer et al.
6,564,411 B2 5/2003 Pirzada
6,571,825 B2 6/2003 Stacy
6,581,223 B1 6/2003 Wang
6,591,437 B1 7/2003 Phillips
6,623,249 B1 * 9/2003 Rogers ..... F04D 25/084 417/201
6,679,686 B2 1/2004 Wang
6,686,711 B2 2/2004 Rose et al.
6,698,046 B1 * 3/2004 Wu ..... A47C 27/082 137/625.15
6,709,246 B2 3/2004 Boyd
6,718,584 B2 4/2004 Rabaiotti et al.
6,722,306 B1 4/2004 Wang
6,754,925 B1 6/2004 Wang
6,754,926 B2 6/2004 Wang
6,755,208 B2 6/2004 Chaffee
6,763,540 B1 7/2004 Wang
6,763,541 B2 7/2004 Mahoney et al.
6,793,469 B2 9/2004 Chung
6,800,165 B2 10/2004 Wang
6,832,630 B2 12/2004 Wu
6,928,681 B1 8/2005 Stacy
6,990,700 B2 1/2006 Chung
7,020,921 B2 * 4/2006 Wang ..... A47C 20/048 5/706
7,028,358 B2 4/2006 Liu
7,036,171 B2 5/2006 Wu
7,040,347 B2 5/2006 Wang
7,089,618 B1 8/2006 Metzger
7,114,204 B2 10/2006 Patrick
7,114,207 B2 10/2006 Wang
7,120,955 B2 10/2006 Wang
RE39,408 E 11/2006 Wang
7,131,701 B1 11/2006 Yang
7,141,101 B2 11/2006 Amann
7,152,265 B2 12/2006 Chung
7,198,076 B2 4/2007 Wu
7,210,902 B2 5/2007 Song et al.
7,225,488 B2 6/2007 Wu
7,232,376 B2 6/2007 Droppleman
7,246,394 B2 7/2007 Wang
7,284,291 B2 10/2007 Wang
7,284,968 B2 10/2007 Tsai
7,306,694 B2 12/2007 Wang
7,313,837 B2 1/2008 Wang
7,322,801 B2 1/2008 Li et al.
7,334,274 B2 2/2008 Wang
7,346,944 B2 3/2008 Shaw
7,346,950 B2 3/2008 Chung
7,365,277 B2 4/2008 Wang
7,380,301 B2 6/2008 Chung
7,387,290 B2 6/2008 Wang
7,406,736 B2 8/2008 Flick
7,426,766 B2 9/2008 Gammons
7,434,283 B2 10/2008 Wilkinson et al.
7,444,704 B2 11/2008 Phillips et al.
7,475,443 B2 1/2009 Wang
7,497,416 B2 3/2009 Wang
7,509,698 B2 3/2009 Poulos
7,571,500 B2 8/2009 Wu
7,587,776 B2 9/2009 Poulos
7,588,425 B2 9/2009 Chung
7,597,123 B2 10/2009 Wang
7,647,662 B2 1/2010 Wang
7,648,392 B2 1/2010 Chambers et al.
7,703,160 B2 4/2010 Wang
7,735,164 B1 6/2010 Patrick

(56) References Cited

U.S. PATENT DOCUMENTS 7,739,760 B2 6/2010 Wang et al.
7,739,763 B2 6/2010 Wang et al.
7,784,131 B2 8/2010 Genaro et al.
7,784,132 B2 8/2010 Gonzalez et al.
7,789,194 B2 9/2010 Lathrop et al.
7,805,785 B2 10/2010 Rawls-Meehan
7,877,829 B2 2/2011 Gonzalez et al.
7,886,386 B2 2/2011 Balonick et al.
7,922,461 B2 4/2011 Wang
RE42,559 E 7/2011 Wang
7,979,169 B2 7/2011 Rawls-Meehan
8,024,830 B2 9/2011 Wang et al.
8,032,263 B2 10/2011 Rawls-Meehan
8,032,960 B2 10/2011 Rawls-Meehan
8,033,797 B2 10/2011 Kehrmann et al.
8,033,800 B2 10/2011 Pan
8,046,117 B2 10/2011 Rawls-Meehan
8,051,517 B2 11/2011 Wang et al.
8,052,630 B2 11/2011 Kloecker et al.
8,078,336 B2 12/2011 Rawls-Meehan
8,078,337 B2 12/2011 Rawls-Meehan
8,083,396 B2 12/2011 Wang
8,087,113 B2 1/2012 Roff et al.
8,104,126 B2 1/2012 Caminade et al.
8,125,318 B2 2/2012 Heimbrock et al.
8,151,390 B2 4/2012 Wang et al.
8,156,589 B2 4/2012 Liu et al.
8,157,535 B2 4/2012 Wang et al.
8,162,009 B2 4/2012 Chaffee
8,176,588 B2 5/2012 Lin
8,192,298 B2 6/2012 Droppleman
8,210,834 B2 7/2012 Tsai
8,214,953 B2 7/2012 Wang
8,216,290 B2 7/2012 Shawver et al.
8,235,684 B2 8/2012 Song et al.
8,276,222 B1 10/2012 Patrick
8,297,309 B2 * 10/2012 Wang ..... F04D 27/008 137/565.15
8,336,369 B2 12/2012 Mahoney
8,348,207 B2 1/2013 Wang et al.
8,413,278 B2 4/2013 Chaffee
8,444,103 B2 5/2013 Wang et al.
8,480,375 B2 7/2013 Tsai
8,549,686 B2 10/2013 Wang et al.
8,561,230 B2 10/2013 Shaw
8,641,391 B2 2/2014 Pan
8,646,812 B2 2/2014 Chien et al.
8,656,539 B1 2/2014 Boyd
8,678,007 B2 3/2014 Porter, III
8,682,457 B2 3/2014 Rawls-Meehan
8,696,322 B2 4/2014 Kehrmann et al.
8,745,796 B2 6/2014 Liu
8,769,747 B2 7/2014 Mahoney et al.
8,801,392 B2 8/2014 Wang et al.
8,832,886 B2 9/2014 Riley et al.
8,839,473 B1 9/2014 Catala
8,839,474 B2 9/2014 Chaffee
8,863,771 B2 10/2014 Wang et al.
8,887,326 B2 11/2014 Patrick
8,893,339 B2 11/2014 Fleury et al.
8,894,390 B2 11/2014 Hsu
8,905,981 B2 12/2014 Budig et al.
8,910,331 B2 12/2014 Wang et al.
8,931,329 B2 1/2015 Mahoney
8,966,689 B2 3/2015 McGuire et al.
9,033,678 B2 5/2015 Tsai
9,062,668 B2 6/2015 Wang et al.
9,114,048 B2 8/2015 Takeda et al.
9,121,519 B2 9/2015 Wang et al.
9,125,777 B2 9/2015 Patrick
9,127,798 B2 9/2015 Wu
9,157,433 B2 10/2015 Wang et al.
9,211,018 B2 12/2015 Wang
9,211,019 B2 * 12/2015 Driscoll, Jr. ..... A47C 27/082
9,241,580 B2 1/2016 Patrick et al.
9,279,510 B2 3/2016 Chaffee
9,289,073 B2 3/2016 Chaffee
9,295,336 B2 3/2016 Driscoll et al.
9,314,105 B2 4/2016 Ralws-Meehan
9,314,388 B2 4/2016 Patrick
9,364,386 B2 6/2016 Siegner
9,371,828 B2 6/2016 Tsai
9,371,837 B2 6/2016 Tsai
9,395,076 B2 7/2016 Wang et al.
9,541,096 B2 1/2017 Tsai
9,719,541 B2 8/2017 De Grasse
9,729,430 B2 8/2017 Weinstein
9,848,706 B2 12/2017 Wang et al.
9,879,682 B1 1/2018 Beliveau et al.
9,913,547 B2 * 3/2018 Driscoll, Jr. ..... A47C 27/082
9,989,979 B2 6/2018 Wang et al.
10,104,967 B2 10/2018 Wang et al.
10,443,602 B2 10/2019 Liu
10,502,218 B2 12/2019 Liu
10,851,795 B2 * 12/2020 Lin ..... F04D 27/008
10,851,796 B2 12/2020 Li
2003/0159218 A1 8/2003 Lin et al.
2005/0079010 A1 4/2005 Droppleman
2005/0079077 A1 4/2005 Tsai et al.
2006/0117488 A1 6/2006 Hung et al.
2006/0204361 A1 9/2006 Xie
2006/0222535 A1 10/2006 Liu
2007/0033738 A1 2/2007 Tu
2008/0201857 A1 8/2008 Kelly
2010/0247337 A1 9/2010 Tsai
2010/0247356 A1 9/2010 Tsai
2011/0073202 A1 3/2011 Feingold et al.
2011/0173758 A1 7/2011 Fontaine
2011/0259449 A1 10/2011 Wang et al.
2011/0284108 A1 11/2011 Wang et al.
2011/0314612 A1 12/2011 Hsu
2012/0133182 A1 5/2012 Chiu
2012/0304391 A1 12/2012 Driscoll et al.
2013/0134764 A1 5/2013 Groh
2013/0230410 A1 9/2013 Tsai
2014/0090176 A1 4/2014 Boyd
2014/0188285 A1 7/2014 Rawls-Meehan
2014/0205123 A1 7/2014 Lafort et al.
2014/0250597 A1 9/2014 Chen et al.
2014/0259434 A1 9/2014 Nunn et al.
2014/0277611 A1 9/2014 Nunn et al.
2014/0298589 A1 10/2014 Bailey
2014/0366957 A1 12/2014 Wang et al.
2015/0026896 A1 1/2015 Fleury et al.
2015/0082547 A1 3/2015 Boyd
2015/0082548 A1 3/2015 Boyd
2015/0089748 A1 4/2015 Toms et al.
2015/0135444 A1 5/2015 Spahn et al.
2015/0157137 A1 6/2015 Nunn et al.
2015/0164236 A1 6/2015 Driscoll et al.
2015/0182033 A1 7/2015 Brosnan et al.
2015/0265056 A1 9/2015 Wang et al.
2015/0308454 A1 10/2015 Shi
2015/0366368 A1 12/2015 Cheng
2015/0374137 A1 12/2015 Mahoney et al.
2016/0106620 A1 4/2016 Uno et al.
2016/0120331 A1 5/2016 Wang et al.
2016/0215780 A1 7/2016 Liu
2016/0238000 A1 8/2016 Suarez
2017/0130728 A1 5/2017 Liu
2017/0156519 A1 6/2017 Cheng
2017/0202364 A1 7/2017 Ohno et al.
2017/0274396 A1 9/2017 Wang et al.
2017/0280884 A1 10/2017 Liu
2017/0292553 A1 10/2017 De Grasse
2018/0335042 A1 11/2018 Lin et al.
2020/0132083 A1 4/2020 Liu
2021/0018013 A1 1/2021 Li

FOREIGN PATENT DOCUMENTS

CN 2746161 Y 12/2005
CN 2750081 Y 1/2006
CN 1260478 C 6/2006

(56) References Cited

FOREIGN PATENT DOCUMENTS

| | | | |
|---|---|---|---|
| CN | 1928419 | A | 3/2007 |
| CN | 201050491 | Y | 4/2008 |
| CN | 201090463 | Y | 7/2008 |
| CN | 201091399 | Y | 7/2008 |
| CN | 101310650 | A | 11/2008 |
| CN | 101439583 | A | 5/2009 |
| CN | 201273290 | Y | 7/2009 |
| CN | 201347870 | Y | 11/2009 |
| CN | 102022364 | A | 4/2011 |
| CN | 201953695 | U | 8/2011 |
| CN | 103600502 | A | 2/2014 |
| CN | 104441637 | A | 3/2015 |
| CN | 105283098 | A | 1/2016 |
| CN | 205064308 | U | 3/2016 |
| CN | 205434304 | U | 8/2016 |
| CN | 105952663 | A | 9/2016 |
| CN | 205744550 | U | 11/2016 |
| CN | 107795517 | A | 3/2018 |
| DE | 1479712 | A1 | 7/1969 |
| DE | 202012002366 | U1 | 6/2012 |
| DE | 202014100140 | U1 | 4/2014 |
| DE | 202014102362 | U1 | 10/2014 |
| EP | 3059451 | A1 | 8/2016 |
| GB | 2428751 | A | 2/2007 |
| JP | 04-067428 | A | 3/1992 |
| JP | 05-084123 | A | 4/1993 |
| JP | 07-054781 | A | 2/1995 |
| JP | 2000-197672 | A | 7/2000 |
| JP | 3182060 | B2 | 7/2001 |
| JP | 2013-127206 | A | 6/2013 |
| JP | 5929157 | B2 | 6/2016 |
| SU | 268313 | A1 | 4/1970 |
| WO | 02/15835 | A1 | 2/2002 |
| WO | 2008/037136 | A1 | 4/2008 |
| WO | 2017/064553 | A1 | 4/2017 |

OTHER PUBLICATIONS

International Search Report and Written Opinion received for PCT Patent Application No. PCT/IB2018/059009, dated Feb. 11, 2019, 10 pages.

Yingyi Motor, Micro Air Pump (2004), 4 pages, www.yingyimotor.com/product/60423125783-801366169/Micro_Air_Pump_YYP370_XB2_DC3V_6V_9V_12V_24V.html, Nov. 12, 2019.

* cited by examiner

MULTICHANNEL AIR PUMP

CROSS REFERENCE TO RELATED APPLICATION

This application is a national stage application of PCT International Application No. PCT/IB2018/059009, filed Nov. 15, 2018, which claims priority to Chinese Application Serial No. 201721523732.4, filed Nov. 15, 2017, Chinese Application Serial No. 201711129250.5, filed Nov. 15, 2017, and Chinese Application Serial No. 201820730684.4, filed May 16, 2018, the disclosures of which are hereby expressly incorporated by reference herein in their entirety.

FIELD OF THE DISCLOSURE

The present disclosure relates to air pumps for the inflation or deflation of inflatable products. More particularly, the present disclosure relates to multichannel air pumps for the inflation or deflation of an inflatable product with multiple inflatable chambers.

BACKGROUND OF THE DISCLOSURE

Inflatable products are common in households as a result of the convenience of storage or transportation when such products are in a deflated state coupled with the utility of such products when such products are in an inflated state. For example, air mattresses are often used in households for activities such as camping or providing overnight guests with a bed. Air mattresses are generally provided with at least one inflatable air chamber and may be inflated or deflated using a built-in pump.

Air mattresses may be provided with more than one inflatable chamber so that each chamber may be inflated to a different pressure for increased comfort. In such an air mattress, multiple pumps may need to be mounted on the air mattress, increasing the production cost, maintenance cost, and overall weight of the mattress, as well as lessening the convenience of the product.

SUMMARY

The present disclosure provides a multichannel air pump for use with inflatable products with multiple inflatable chambers. Specifically, the present disclosure provides an air pump that may be used to selectively inflate or deflate individual chambers of an inflatable product to varying pressures.

According an exemplary embodiment of the present disclosure, a multichannel air assembly is provided for use with an inflatable product having at least a first chamber and a second chamber, the air assembly including: a main body forming a main body chamber and further including a first vent in communication with a surrounding environment, a first port in communication with the first chamber, and a second port in communication with the second chamber; a control mechanism coupled to the main body; a channel switching mechanism disposed in the main body and operably coupled to the control mechanism, the channel switching mechanism configured to place the main body chamber in selective communication with a selected one of the first and second ports; and an air pump assembly disposed in the main body in communication with the first vent and operably coupled to the control mechanism, the air pump assembly operable in: an inflation state in which the air pump assembly directs air from the surrounding environment to the selected port to inflate the corresponding chamber of the inflatable product; and a deflation state in which the air pump assembly directs air from the selected port to the surrounding environment to deflate the corresponding chamber of the inflatable product.

According another exemplary embodiment of the present disclosure, a multichannel air assembly is provided for use with an inflatable product having at least a first chamber and a second chamber, the air assembly including: a main body including a first port in communication with the first chamber and a second port in communication with the second chamber; a channel switching mechanism disposed in the main body and including a first rotating disc with a first vent hole and a second rotating disc with a second vent hole, the channel switching mechanism having: a first state in which the first and second rotating discs close the first and second ports; a second state in which the second vent hole in the second rotating disc partially opens a selected one of the first and second ports; and a third state in which the first vent hole in the first rotating disc and the second vent hole in the second rotating disc fully open the selected port; and an air pump assembly disposed in the main body, the air pump assembly operable in an inflation state in which the air pump assembly directs air to the selected port to inflate the corresponding chamber of the inflatable product and a deflation state in which the air pump assembly directs air from the selected port to deflate the corresponding chamber of the inflatable product.

According yet another exemplary embodiment of the present disclosure, a multichannel air assembly is provided for use with an inflatable product having at least two chambers, the air assembly including: a main body forming a main body chamber with an opening, the main body including at least two ports in respective communication with the at least two chambers; a main body panel covering the opening of the main body; a control panel coupled to the main body panel and comprising a vent and a control key operably connected to a circuit board; an air pump assembly disposed in the main body chamber, the air pump assembly including: a pump cover comprising an air inlet; a pump body cooperating with the pump cover to form an impeller chamber; an impeller disposed in the impeller chamber; and a pump motor comprising a rotating shaft disposed through the pump body and coupled to the impeller; a directional control valve disposed in the main body chamber and including: a first motor operably coupled to the circuit board; and a switching component movably disposed between the pump cover and the main body panel to place the air inlet of the pump cover in selective communication with the main body chamber or the vent of the control panel, the switching component operably coupled to the first motor; and a channel switching mechanism disposed in the main body chamber, the channel switching mechanism including: a second motor operably coupled to the circuit board, the second motor including a rotating shaft; a first rotating disc fixedly coupled to the rotating shaft and comprising a third vent in communication with the main body chamber; and a second rotating disc configured to selectively rotate with the first rotating disc, the second rotating disc including a fourth vent in selective communication with the at least two ports and the third vent of the first rotating disc.

BRIEF DESCRIPTION OF THE DRAWINGS

The above-mentioned and other features and advantages of this disclosure, and the manner of attaining them, will become more apparent and will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention and such exemplifications are not to be construed as limiting the scope of the invention in any manner.

DETAILED DESCRIPTION OF THE DRAWINGS

Referring generally to FIGS. 1-10, a multichannel air assembly 1000 is disclosed, which includes an air pump assembly 1002 and a channel switching mechanism 1003, both of which are disposed in a chamber 1012 formed by a main body 1001. A first vent 1013 is in communication with the surrounding environment and the main body chamber 1012 through the air pump assembly 1002, and the main body chamber 1012 is in selective communication with one or more of inflation/deflation channels or ports 1014, illustratively three ports 1014*a-c*, through the channel switching mechanism 1003. As shown in FIG. 5A, the multichannel air assembly 1000 is built into an inflatable product P, such as an air mattress, having multiple air chambers C, illustratively three air chambers Ca-c (e.g., a head chamber Ca, a foot chamber Cb, and a body chamber Cc). The multichannel air assembly 1000 communicates with the air chambers Ca-c through the corresponding ports 1014*a-c* and one or more optional hoses H. In an embodiment, one chamber Ca-c of the inflatable product P is selected by a user through an electronic control mechanism 1018 (FIGS. 1-2), which then uses the channel switching mechanism 1003 to place the selected chamber Ca-c into communication with the main body chamber 1012 and the air pump assembly 1002 via the corresponding port 1014*a-c* so that the selected air chamber Ca-c of the inflatable product P is either inflated or deflated.

Figure 1:
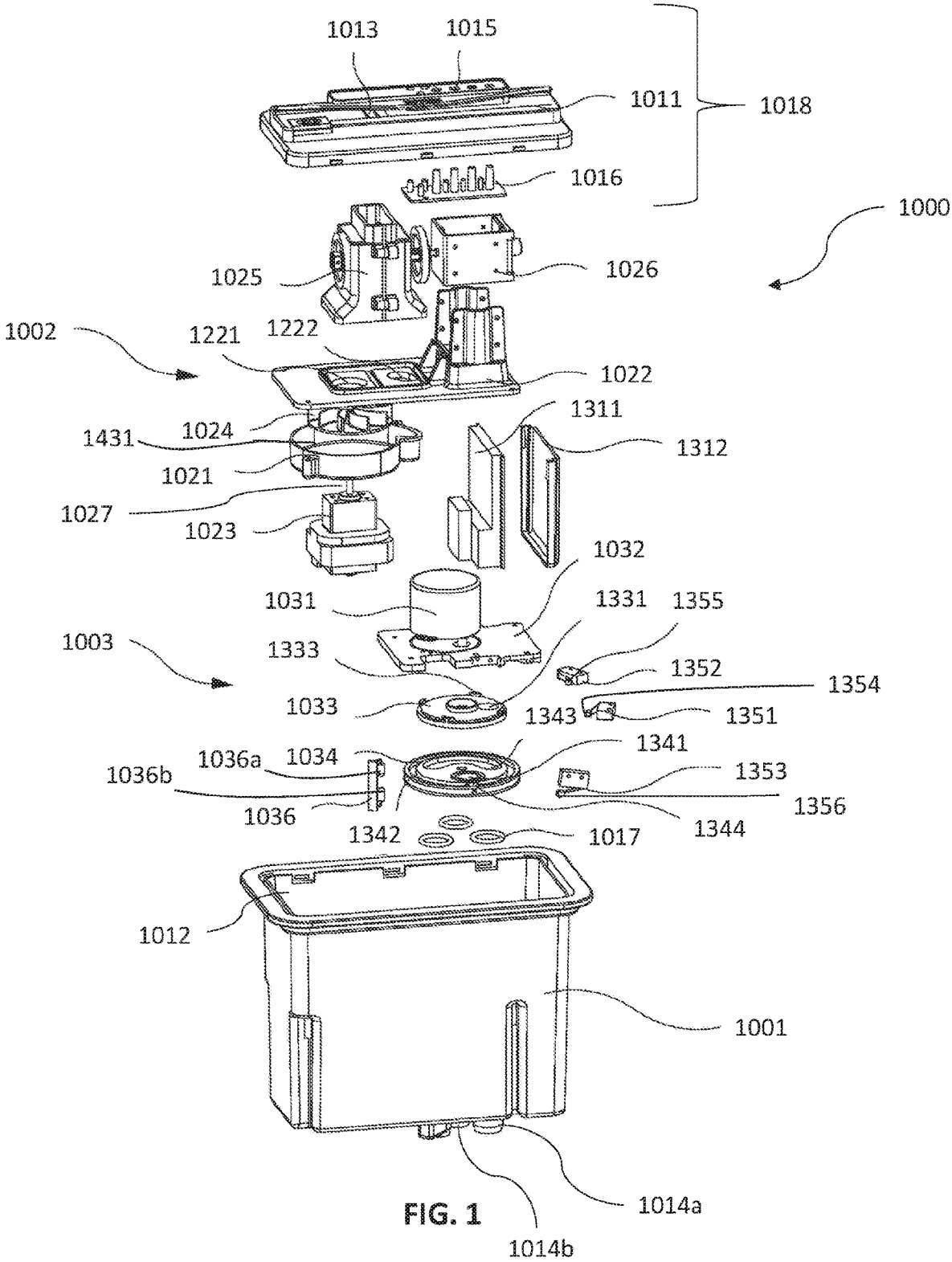
FIG. 1 illustrates an exploded, perspective view of an exemplary multichannel air assembly, including a main body, an air pump assembly, a channel switching mechanism, and a control mechanism.
Figure 2:
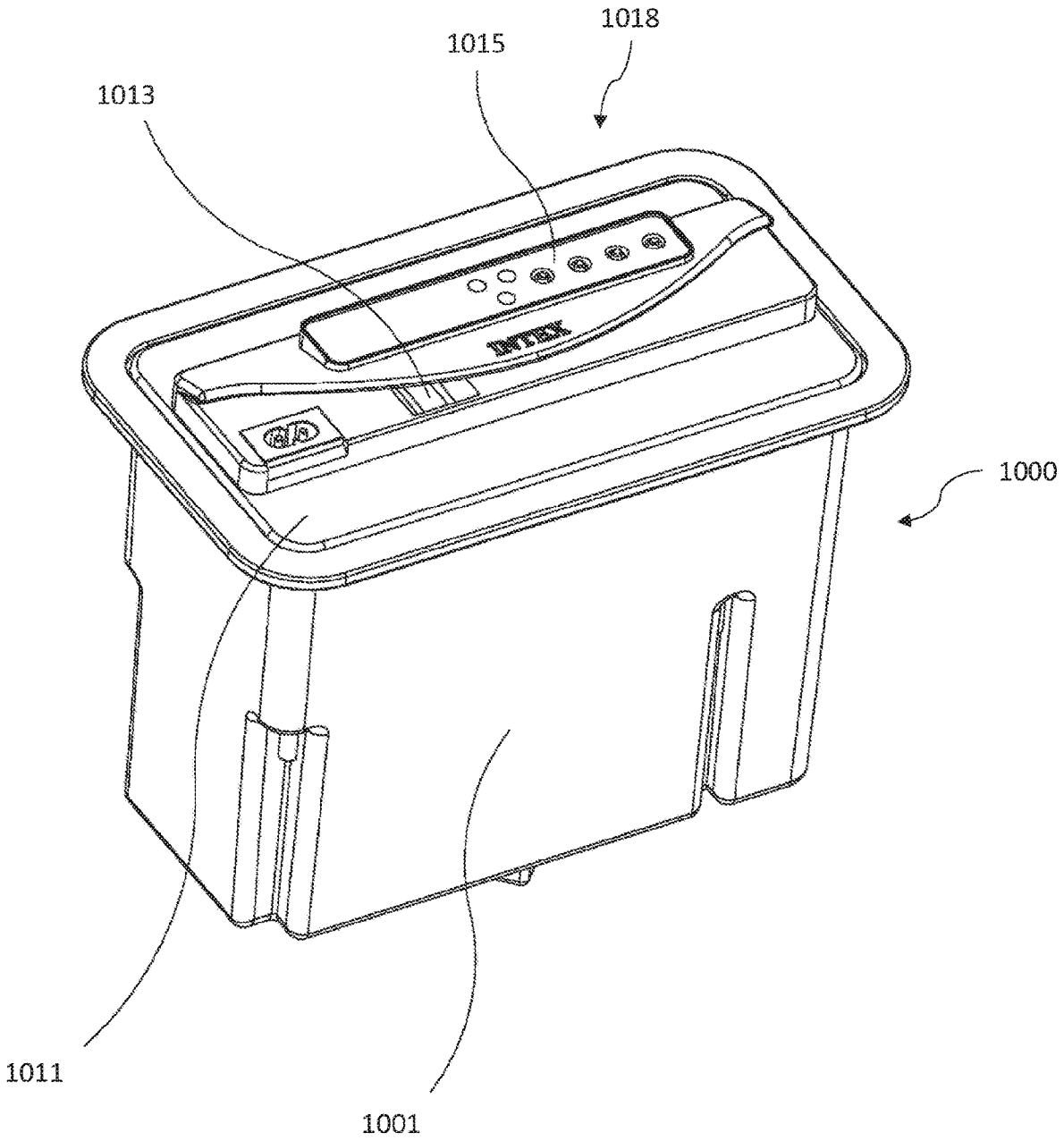
FIG. 2 illustrates a perspective view of the air pump of FIG. 1, illustrating a control panel of the exemplary multichannel air assembly.

Referring to FIGS. 1-2, a panel 1011 is coupled to the main body chamber 1012. The panel 1011 defines the first vent 1013 and supports the control mechanism 1018 for controlling the air pump assembly 1002 and the channel switching mechanism 1003 (FIG. 1). The control mechanism 1018 includes a plurality of control switches 1015 attached to the top of the panel 1011 for user access, and a plurality of control keys 1016 coupled to the bottom of panel 1011 (FIG. 1) and operatively coupled to the corresponding control switches 1015. As shown in FIG. 1, the main body 1001 also contains a circuit board 1311 that receives the user's inputs from the control mechanism 1018. The circuit board 1311 is coupled to the sheath 1312, which couples to a sidewall of the main body 1001 to fix the position of the sheath 1312 within the main body chamber 1012.

A pump cover 1022 is coupled to the main body 1001 to fix the position of the air pump assembly 1002 in the main body chamber 1012. The pump cover 1022 cooperates with a pump body 1021 to form an impeller chamber 1431, which holds impeller 1024. The pump cover 1022 defines an inlet vent 1221 leading into the impeller chamber 1431 and an outlet vent 1222 leading from the impeller chamber 1431. The bottom of the impeller 1024 is coupled to a unidirectional air pump motor 1023 via a rotating shaft 1027 of the motor 1023. The rotating shaft 1027 of motor 1023 is disposed through the pump body 1021 so that motor 1023 is located below pump body 1021 and impeller 1024 is located above pump body 1021. In operation, when the user inputs a command to the control mechanism 1018 to operate the air pump assembly 1002, the circuit board 1311 operates the motor 1023 to rotate the impeller 1024, which pulls air into the inlet vent 1221 and discharges air from the outlet vent 1222.

Figure 3:
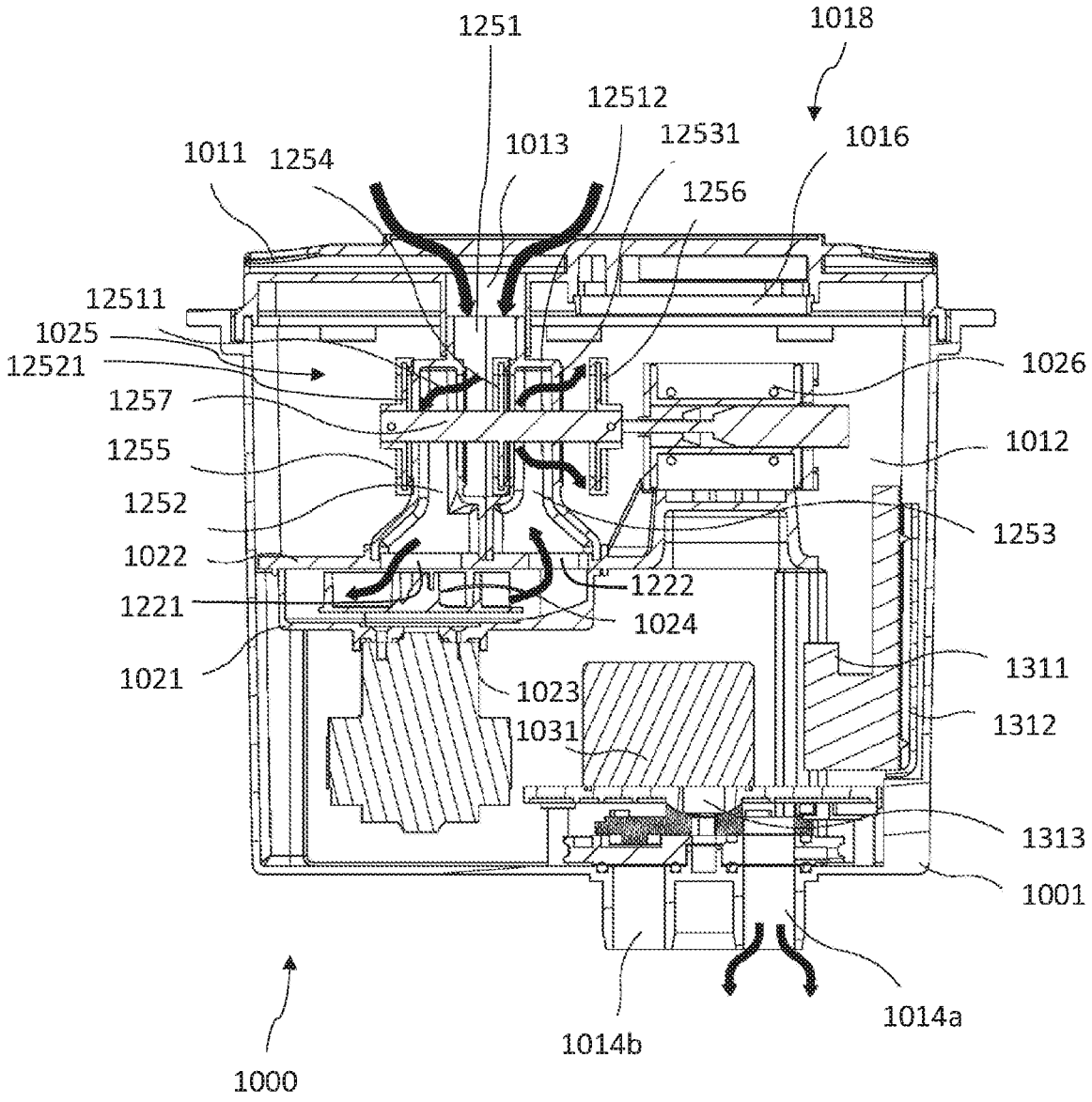
FIG. 3 illustrates a cross section view of the air pump of FIG. 1, illustrating the path of air flow through the air pump assembly during inflation of a specified air chamber of an inflatable product.
Figure 4:
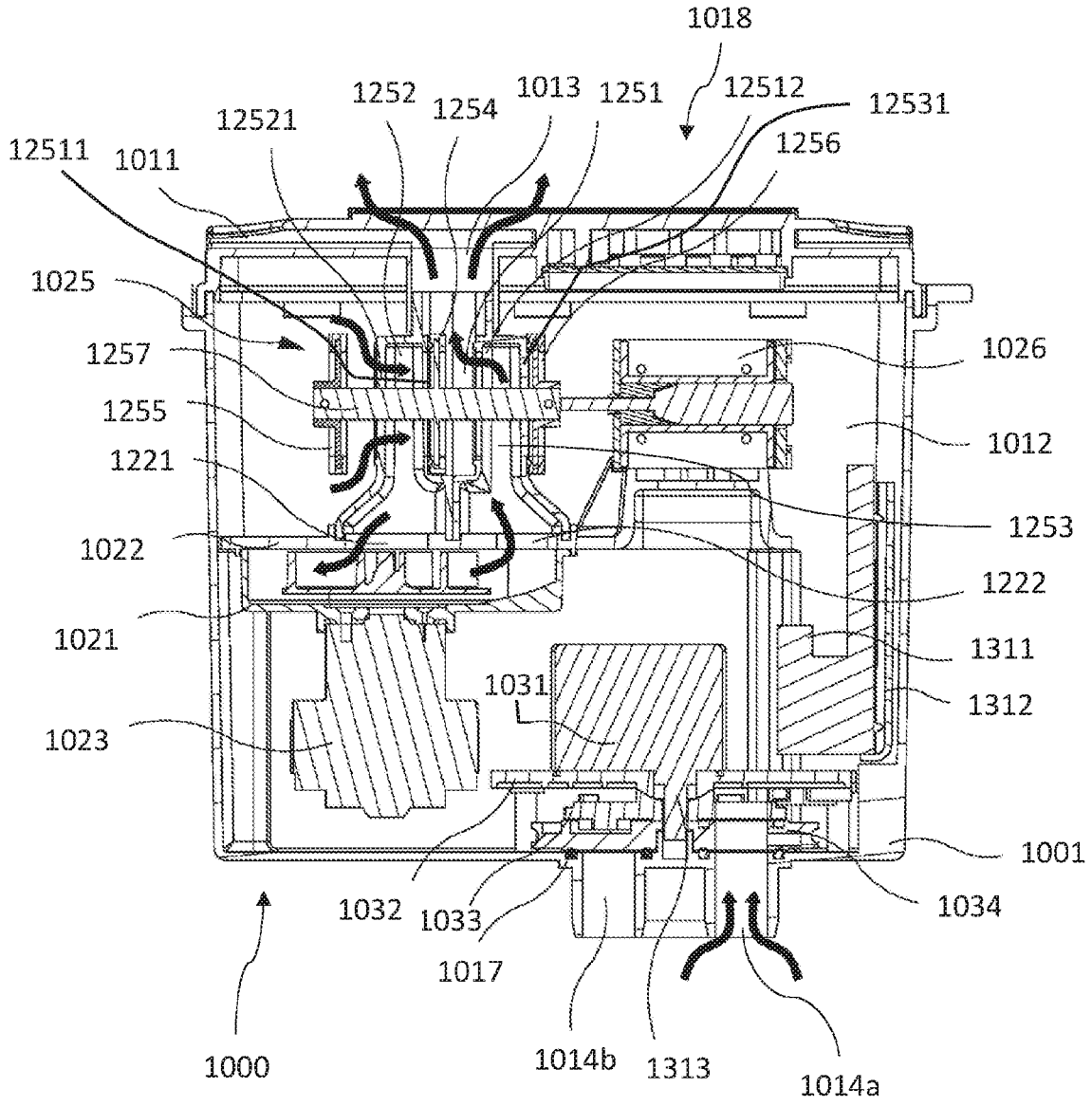
FIG. 4 illustrates a cross section view of the air pump of FIG. 1, illustrating the path of air flow through the air pump assembly during deflation of a specified air chamber of an inflatable product.
Figure 5:
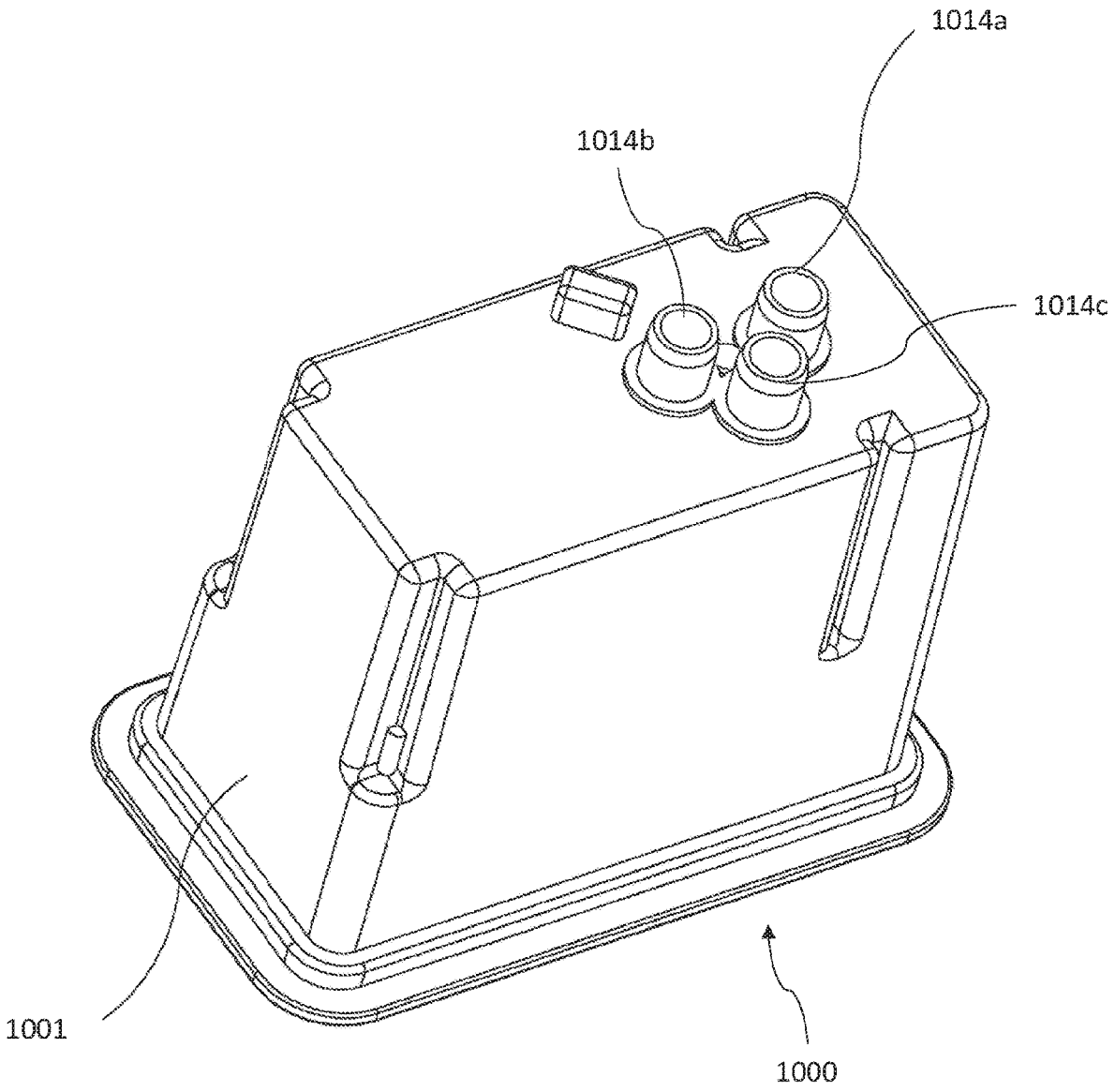
FIG. 5 illustrates a bottom, perspective view of the air pump of FIG. 1, illustrating a plurality of inflation/deflation ports of the exemplary multichannel air assembly.
Figure 5A:
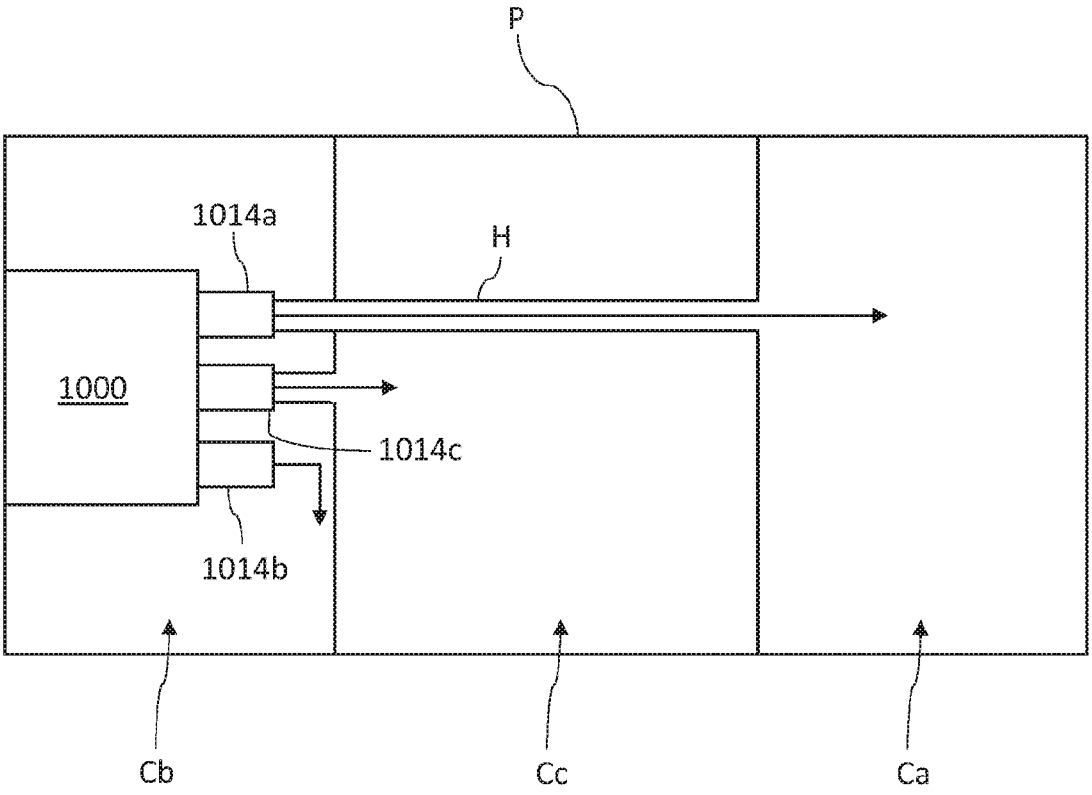
FIG. 5A illustrates a schematic view of the air assembly of FIG. 1 built into an inflatable product having multiple air chambers.

Referring now to FIGS. 3-4, the air pump assembly 1002 (FIG. 1) is configured to operate in an inflation state in which air is pumped into the inflatable product P to inflate the product P (FIG. 5A) and a deflation state in which air is pumped out of the inflatable product P to deflate the product P (FIG. 5A). In another embodiment, the air pump assembly 1002 may be configured to only perform in an inflation state or configured to only perform in a deflation state. The air pump assembly 1002 includes a directional control valve 1025 that adjusts the air pump assembly 1002 between the inflation and deflation states. The directional control valve 1025 is coupled to the control mechanism 1018 via a solenoid valve 1026 and is also coupled to the pump cover 1022 in such a way that the directional control valve 1025 controls the airflow to the inlet vent 1221 and from the outlet vent 1222.

Still referring to FIGS. 3-4, the directional control valve 1025 includes a first air duct 1251 in communication with the first vent 1013 on the panel 1011, a second air duct 1252 illustratively positioned on a left side of the first air duct 1251 and having a flared end that communicates with the inlet vent 1221, and a third air duct 1253 illustratively positioned on a right side of the first air duct 1251 and having a flared end that communicates with the outlet vent 1222. The second air duct 1252 also has an interior, first air hole 12511 in selective communication with the first air duct 1251 (FIG. 3) and an outer, second air hole 12521 in selective communication with the surrounding main body chamber 1012 (FIG. 4). Similarly, the third air duct 1253 has an interior, third air hole 12512 in selective communication with the first air duct 1251 (FIG. 4) and an outer, fourth air hole 12531 in selective communication with the surrounding main body chamber 1012 (FIG. 4).

The directional control valve 1025 further includes a plurality of baffles 1254, 1255, 1256 coupled to a connecting shaft 1257. The first baffle 1254 is positioned within the first air duct 1251 and is configured to selectively cover the first air hole 12511 to the second air duct 1252 (FIG. 4) or the third air hole 12512 to the third air duct 1253 (FIG. 3) to block air flow. The second baffle 1255 is positioned along an external side of the second air duct 1252 and is configured to selectively cover the second air hole 12521 (FIG. 3). The third baffle 1256 is positioned along an external side of the third air duct 1253 and is configured to selectively cover fourth air hole 12531 (FIG. 4). First baffle 1254, second baffle 1255, and third baffle 1256 are coaxially coupled through connecting shaft 1257. Connecting shaft 1257 is coupled to the solenoid valve 1026 so that solenoid valve 1026 may control first baffle 1254, second baffle 1255, and third baffle 1256. In operation, when the user inputs an inflation or deflation command to control mechanism 1018, the circuit board 1311 operates the solenoid valve 1026 to move the connecting shaft 1257.

In an inflation state, as seen in FIG. 3, solenoid valve 1026 moves the connecting shaft 1257 to a rightward position such that first baffle 1254 covers third air hole 12512, second baffle 1255 covers second air hole 12521, and third baffle 1256 leaves fourth air hole 12531 uncovered. Illustratively, impeller 1024 draws external air into first air duct 1251 via first vent hole 1013 on panel 1011, into the impeller chamber 1431 (FIG. 1) through second air duct 1252, and into third air duct 1253 through the impeller chamber 1431. The air may move from the impeller chamber 1431 to main body chamber 1012 through fourth air hole 12531 of third air duct 1253, and then is free to enter and inflate the desired air chamber Ca-c of the inflatable product P (FIG. 5A) via channel switching mechanism 1003 and the specified port 1014*a-c*.

In a deflation state, as illustrated in FIG. 4, solenoid valve 1026 moves the connecting shaft 1257 to a leftward position such that first baffle 1254 covers first air hole 12511, second baffle 1255 leaves second air hole 12521 uncovered so that second air duct 1252 is in communication with main body chamber 1012, and third baffle 1256 covers fourth air hole 12531. Illustratively, impeller 1024 draws air from the selected air chamber Ca-c of the inflatable product P into main body chamber 1012 through the specified port 1014*a-c* and channel switching mechanism 1003, into second air duct 1252 through second air hole 12521 of second air duct 1252, through the impeller chamber 1431, into third air duct 1253, into first air duct 1251 through third air hole 12512 of third air duct 1253, and through first air duct 1251 and first vent 1013 and into the surrounding environment to deflate the specified chamber Ca-c of the inflatable product P.

Referring now to FIGS. 5-5A, ports 1014*a-c* are coupled to the bottom of main body 1001 of air assembly 1000. Ports 1014*a-c* communicate with main body chamber 1012 through channel switching mechanism 1003 (FIG. 1). As noted above, the illustrative air assembly 1000 has three ports 1014*a-c* and three corresponding chambers Ca-c. Channel switching mechanism 1003 may open one or more of the desired ports 1014*a-c* such that the multichannel air assembly 1000 selectively inflates or deflates the corresponding air chambers Ca-c of the inflatable product P. In one embodiment, the channel switching mechanism 1003 may open only one of the three ports 1014*a-c* such that the main body chamber 1012 communicates with only one of the three ports 1014*a-c* and its corresponding air chamber Ca-c at one time. In another embodiment, the channel switching mechanism 1003 may open two or more of the ports 1014*a-c* such that the main body chamber 1012 communicates with two or more of the ports 1014*a-c* and their corresponding air chambers Ca-c at one time. The ports 1014*a-c* include gaskets 1017 (FIG. 1) to prevent leakage of air flow before or after the inflation or deflation operations. In other another embodiment, the multichannel air assembly 1000 may include a different number of ports 1014 depending on the number of air chambers C.

Referring generally to FIG. 1, the channel switching mechanism 1003 is located within the main body chamber 1012 and includes a bidirectional motor 1031. The motor 1031 is coupled to an upper cover 1032, which is coupled to a sidewall of the main body chamber 1012 to fix the position of the motor 1031 within the main body chamber 1012. The motor 1031 is operatively coupled to the circuit board 1311. In operation, when the user selects a desired chamber Ca-c (FIG. 5A) through the control mechanism 1018, the circuit board 1311 rotates the motor 1031 in the necessary directions to open the corresponding port 1014*a-c*, as described further below.

Still referring to FIG. 1 and additionally to FIGS. 6-10, the channel switching mechanism 1003 is a rotary mechanism and includes an upper rotating control disc 1033 and a lower rotating seal disc 1034. The rotating disc 1033 and the seal disc 1034 include a first vent hole 1331 and a second vent hole 1341 respectively. The rotating disc 1033 is coupled to the motor 1031 through a rotating shaft 1313 (FIGS. 6-7), which is disposed through and fixedly connected to the rotating disc 1033 so that the motor 1031 can drive the rotating disc 1033 to rotate in either direction via command of the circuit board 1311. The motor 1031, the rotating disc 1033, and the seal disc 1034 are axially stacked together in the direction of the rotating shaft 1313.

The channel switching mechanism 1003 further includes a first signal switch 1351, a second signal switch 1352, a third signal switch 1353, and a sensor 1036. The first signal switch 1351 includes a first contact 1354, the second signal switch 1352 includes a second contact 1355, and the third signal switch 1353 includes a third contact 1356. The first signal switch 1351 and the second signal switch 1352 are coupled to the rotating disc 1033 and are operably coupled to the circuit board 1311, while the third signal switch 1353 and the sensor 1036 are coupled to the seal disc 1034 and are operably coupled to the circuit board 1311. The circuit board 1311 may also include a counter (not shown) to monitor the signals from the first signal switch 1351, the second signal switch 1352, the signal switch 1353, and/or the sensor 1036.

The rotating disc 1033 includes one or more protrusions 1333 on the outer edge of the rotating disc 1033 configured to touch the first contact 1354 of the first signal switch 1351 and the second contact 1355 of the second signal switch 1352 at appropriate times during the operation of the channel switching mechanism 1003. In certain embodiments, the first contact 1354 and the second contact 1355 are offset from each other by about 45 degrees. In other embodiments, the first contact 1354 may be used alone without the second contact 1355, or vice versa.

The third contact 1356 of the third signal switch 1353 rests within an annular groove 1342 of the seal disc 1034 so that the third contact 1356 slides within the annular groove 1342 when the seal disc 1034 rotates. The annular groove 1342 further contains a positioning point 1344, which is configured to touch the third contact 1356 at appropriate times during the operation of channel switching mechanism 1003, such as when the second vent hole 1341 of the seal disc 1034 is offset from the ports 1014*a-c*. Additionally, seal disc 1034 includes a plurality of sensing apertures 1038 (FIG. 8) corresponding to each port 1014*a-c*. The sensor 1036 is disposed on an outer edge of seal disc 1034 and includes an upper or sensing portion 1036*a* and a lower or sensed portion 1036*b*, although these components may be rearranged. The upper portion 1036*a* of the sensor 1036 is located in or near the annular groove 1342 of seal disc 1034 and the lower portion 1036*b* of the sensor 1036 is located underneath seal disc 1034 so that the upper portion 1036*a* and the lower portion 1036*b* come into communication with each other through one of the sensing apertures 1038 as they pass between the upper portion 1036*a* and the lower portion 1036*b* of sensor 1036. In one embodiment, the upper portion 1036*a* of the sensor 1036 is an induction sensor and the lower portion 1036*b* of the sensor 1036 is a metallic target material, wherein the upper portion 1036*a* detects the lower portion 1036*b* when one of the sensing apertures 1038 rotates into alignment with the sensor 1036.

Figure 8:
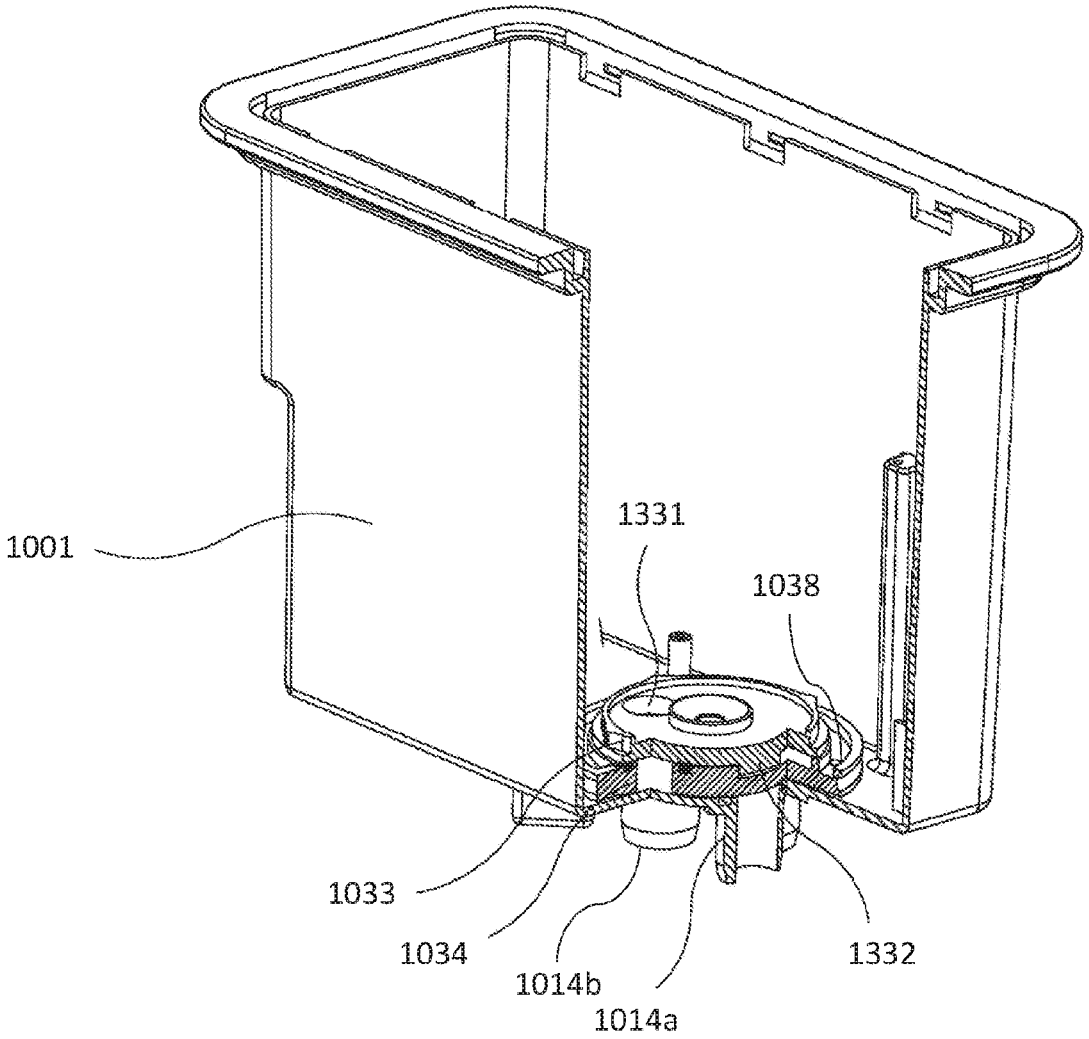
FIG. 8 illustrates a simplified, cross section view of the air assembly of FIG. 1, illustrating the channel switching mechanism when the channel switching mechanism is in a first, sealed switching state.
Figure 9:
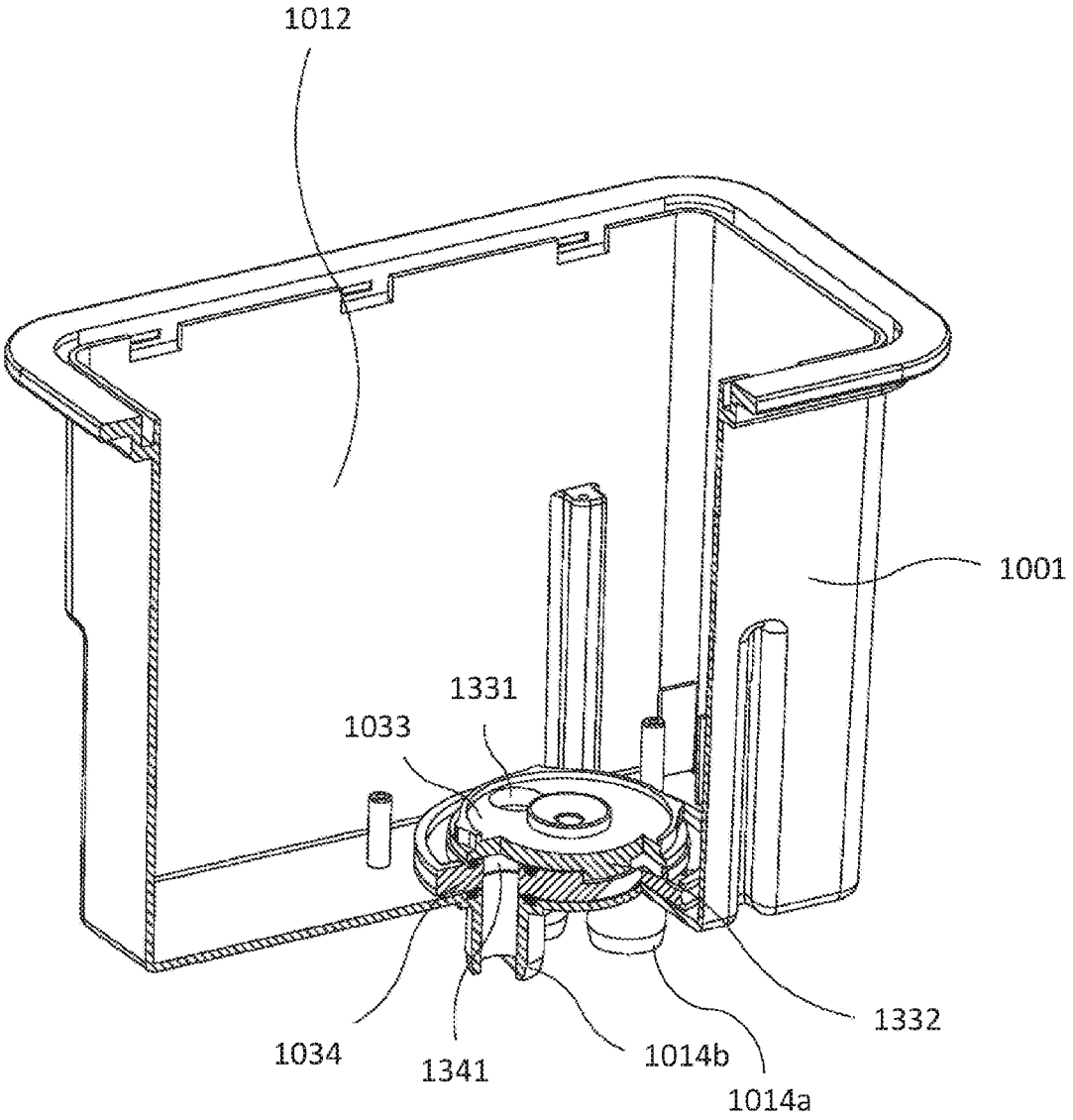
FIG. 9 illustrates a simplified, cross section view of the air assembly of FIG. 1, illustrating the channel switching mechanism when the channel switching mechanism is in a second, partially open switching state.

As illustrated in FIGS. 8-9, the bottom of the rotating disc 1033 includes a boss 1332, which is configured to fit in an arc-shaped groove 1343 (FIG. 1) of the seal disc 1034. The illustrative groove 1343 is positioned across from the second vent hole 1341 and has a span of about 180 degrees. Thus, if the second vent hole 1341 has a 12 o'clock position on the seal disc 1034, the groove 1343 spans from about 3 o'clock to about 9 o'clock on the seal disc 1034.

Figure 6:
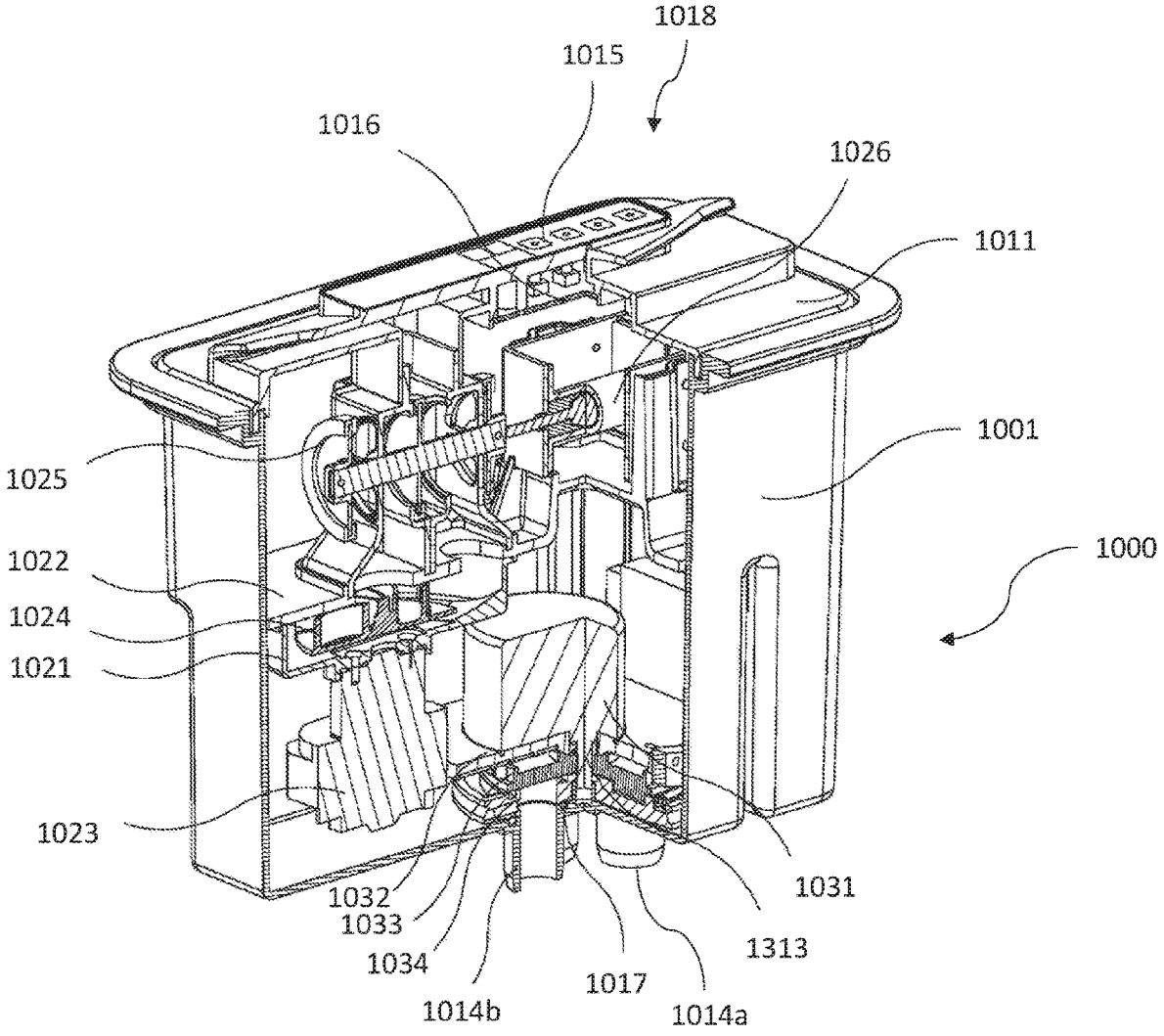
FIG. 6 illustrates a partial cross section view of the air assembly of FIG. 1, illustrating the air pump assembly and the channel switching mechanism of when the channel switching mechanism is in a first position.
Figure 7:
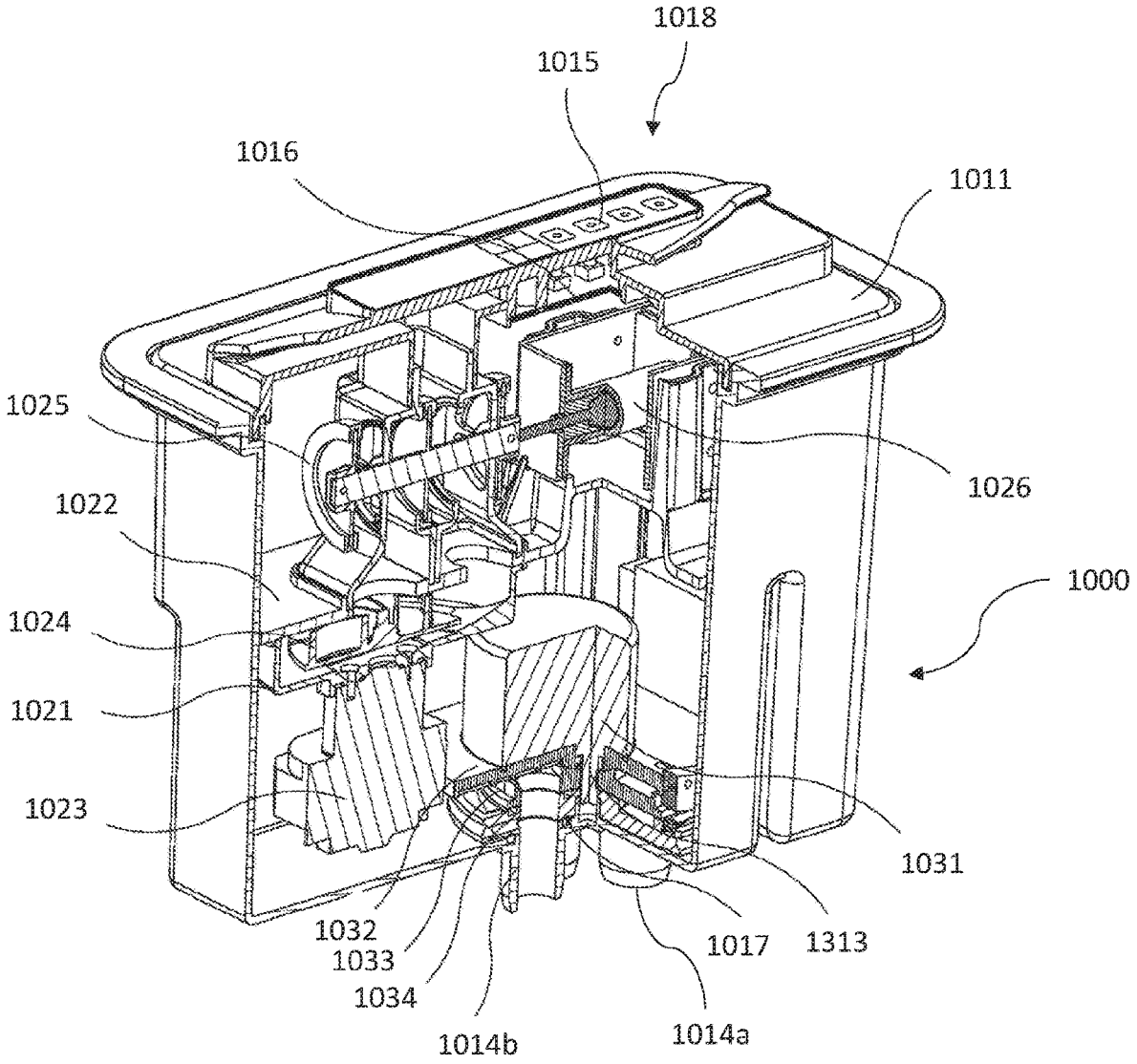
FIG. 7 illustrates a partial cross section view of the air assembly of FIG. 1, illustrating the air pump assembly and the channel switching mechanism when the channel switching mechanism is in a second position.

The operation of channel switching mechanism 1003 will now be described with reference to FIGS. 6-10. As shown in FIGS. 6-7, the process begins when the user inputs a command to control mechanism 1018 to inflate or deflate a desired chamber C, for example chamber Cb corresponding to port 1014*b* (FIG. 5A). The process may begin with the positioning point 1344 touching the contact 1356 of the third signal switch 1353, such that the seal disc 1034 is in a closed state.

Next, the motor 1031 operates according to the current rotary position of the rotating disc 1033 relative to the desired rotary position of the rotating disc 1033 based on the user's input. The operation of the motor 1031 causes the rotating disc 1033 to rotate relative to the seal disc 1034, with the boss 1332 (FIGS. 8-9) sliding in the arc-shaped groove 1343 of the seal disc 1034. This step continues until the boss 1332 contacts the seal disc 1034 at an end of the arc-shaped groove 1343, as shown in FIG. 8.

Then, the motor 1031 continues to rotate the rotating disc 1033 in the same direction, which also rotates the seal disc 1034 with the rotating disc 1033 due to the contact between the boss 1332 and the seal disc 1034. This step continues until the second vent hole 1341 of the seal disc 1034 is aligned with the specified port 1014*b*, as shown in FIG. 9. At this stage, the upper portion 1036*a* of the sensor 1036 and the lower portion 1036*b* of the sensor 1036 are in communication with each other via the corresponding sensing aperture 1038 within the annular groove 1342 of seal disc

1034. The above-described counter may be used to count the sensing apertures 1038 during rotation of seal disc 1034.

Figure 10:
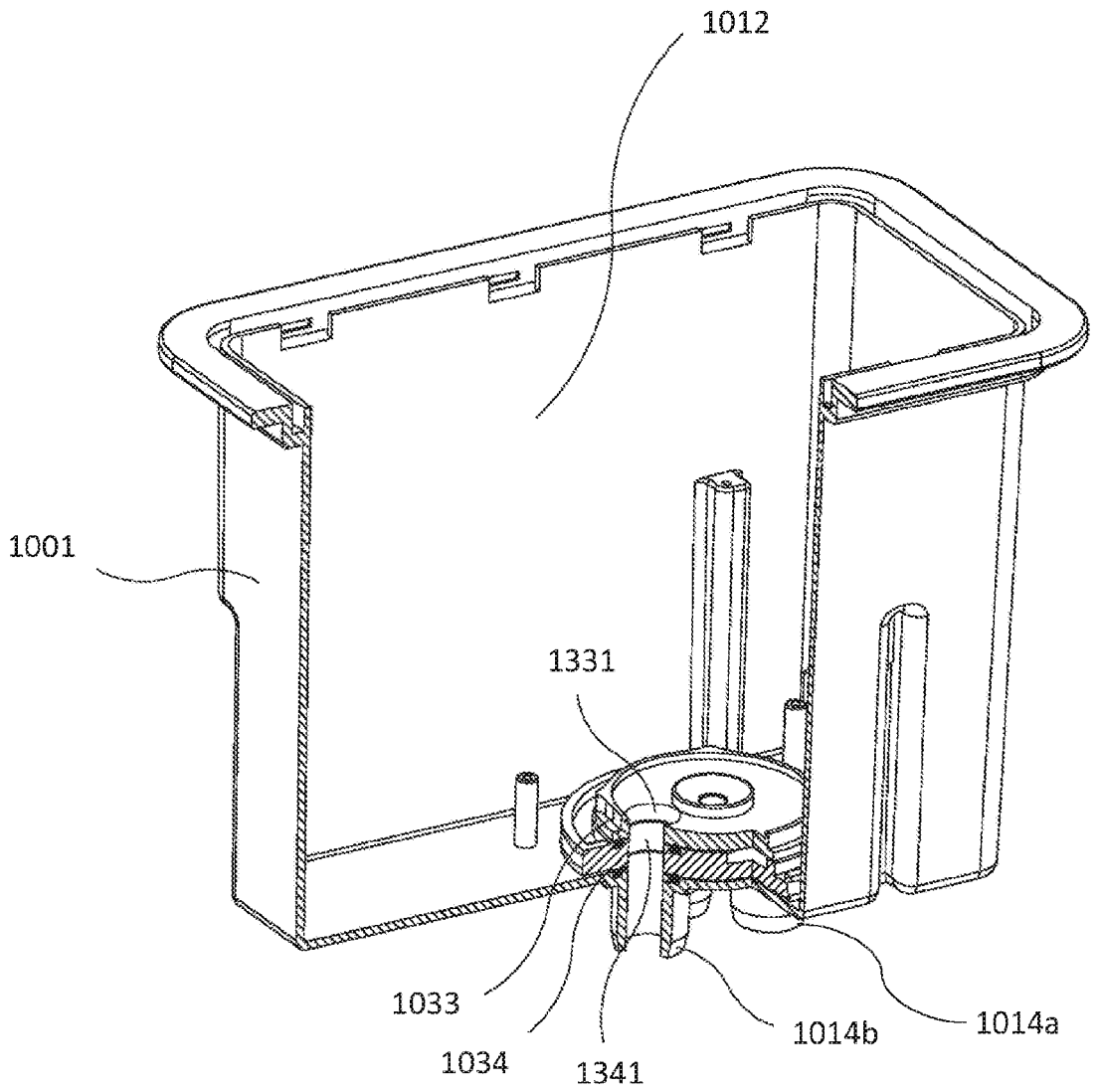
FIG. 10 illustrates a simplified, cross section view of the air assembly of FIG. 1, illustrating the channel switching mechanism when the channel switching mechanism is in a third, fully open switching state.
Figure 11:
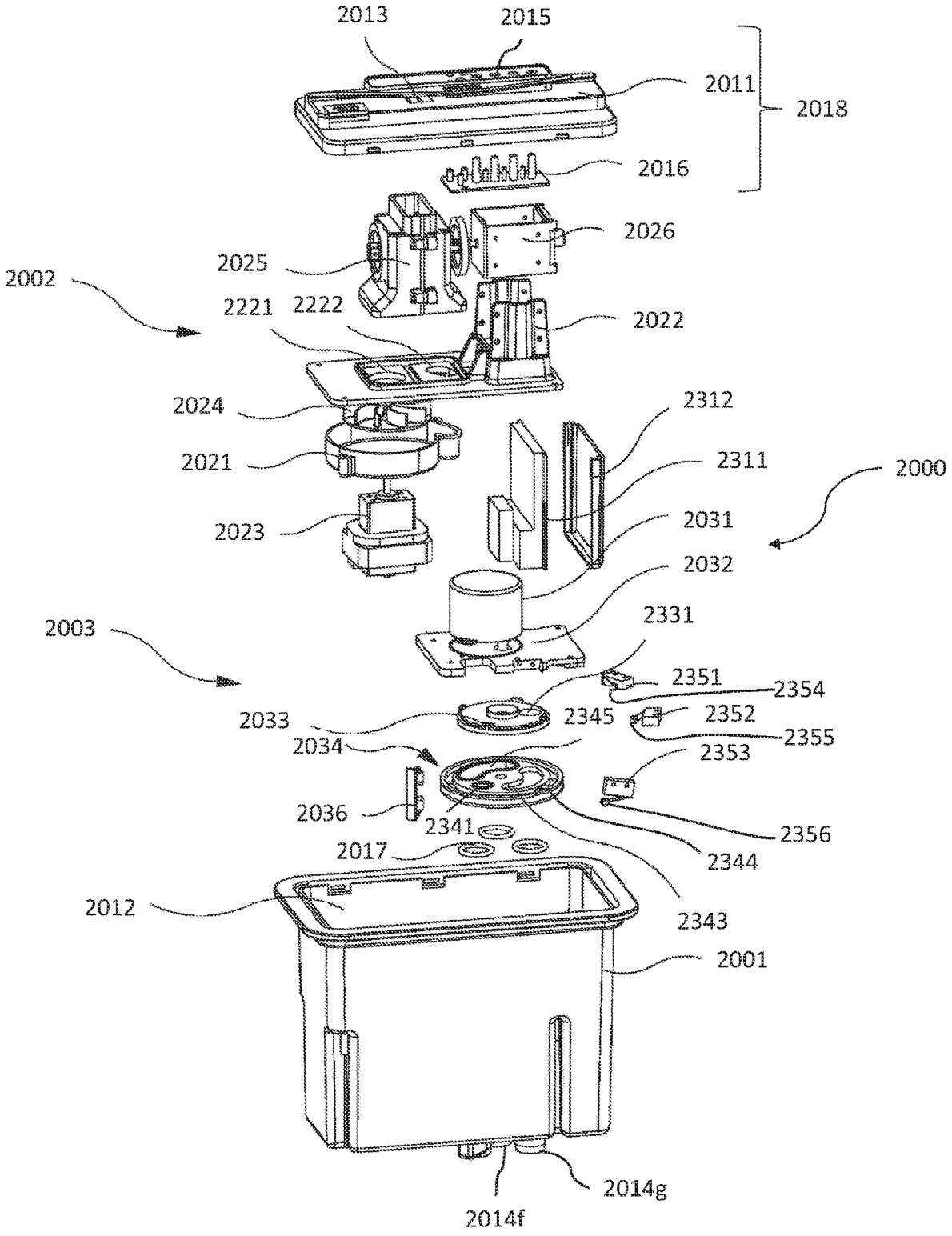
FIG. 11 illustrates an exploded, perspective view of a second exemplary multichannel air assembly, including a main body, an air pump assembly, a channel switching mechanism, and a control mechanism.

Next, motor 1031 reverses direction to rotate in the opposite direction, which releases the boss 1332 from contact with the seal disc 1034 and drives rotating disc 1033 to rotate alone independently of the seal disc 1034 as the boss 1332 travels freely through the arc-shaped groove 1343 in the seal disc 1034. This step continues until first vent hole 1331 of rotating disc 1033 is aligned with second vent hole 1341 of seal disc 1034 and the specified port 1014*b*, as shown in FIG. 10. The position of the rotating disc 1033 relative to the seal disc 1034 may be determined based on engagement between the protrusions 1333 and one or both of the first signal switch 1351 and the second signal switch 1352.

As explained above in connection with FIGS. 3-4, control mechanism 1018 may command air pump assembly 1002 to operate, implementing inflation or deflation of the desired chamber C inflatable product P. More specifically, control mechanism 1018 may transmit signals to circuit board 1311, and then circuit board 1311 may control operation of directional control valve 1025 via solenoid valve 1026 and impeller 1024 via motor 1023. In one embodiment, motor 1023 and impeller 1024 may begin operating once seal disc 1034 is aligned with the specified port 1014*b*, as shown in FIG. 9, but before rotating disc 1033 is also rotated into alignment with the specified port 1014*b*. In this embodiment, motor 1023 and impeller 1024 would generate positive pressure in the main body chamber 1012 in the inflation state and would generate negative pressure in the main body chamber 1012 in the deflation state. When rotating disc 1033 is also rotated into alignment with the specified port 1014*b*, as shown in FIG. 10, motor 1023 and impeller 1024 would continue (or start) operating to inflate or deflate the desired chamber Cb and would continue operating until the desired chamber Cb is inflated or deflated to a desired pressure, which may be controlled via a timer and/or a pressure sensor.

Figure 12:
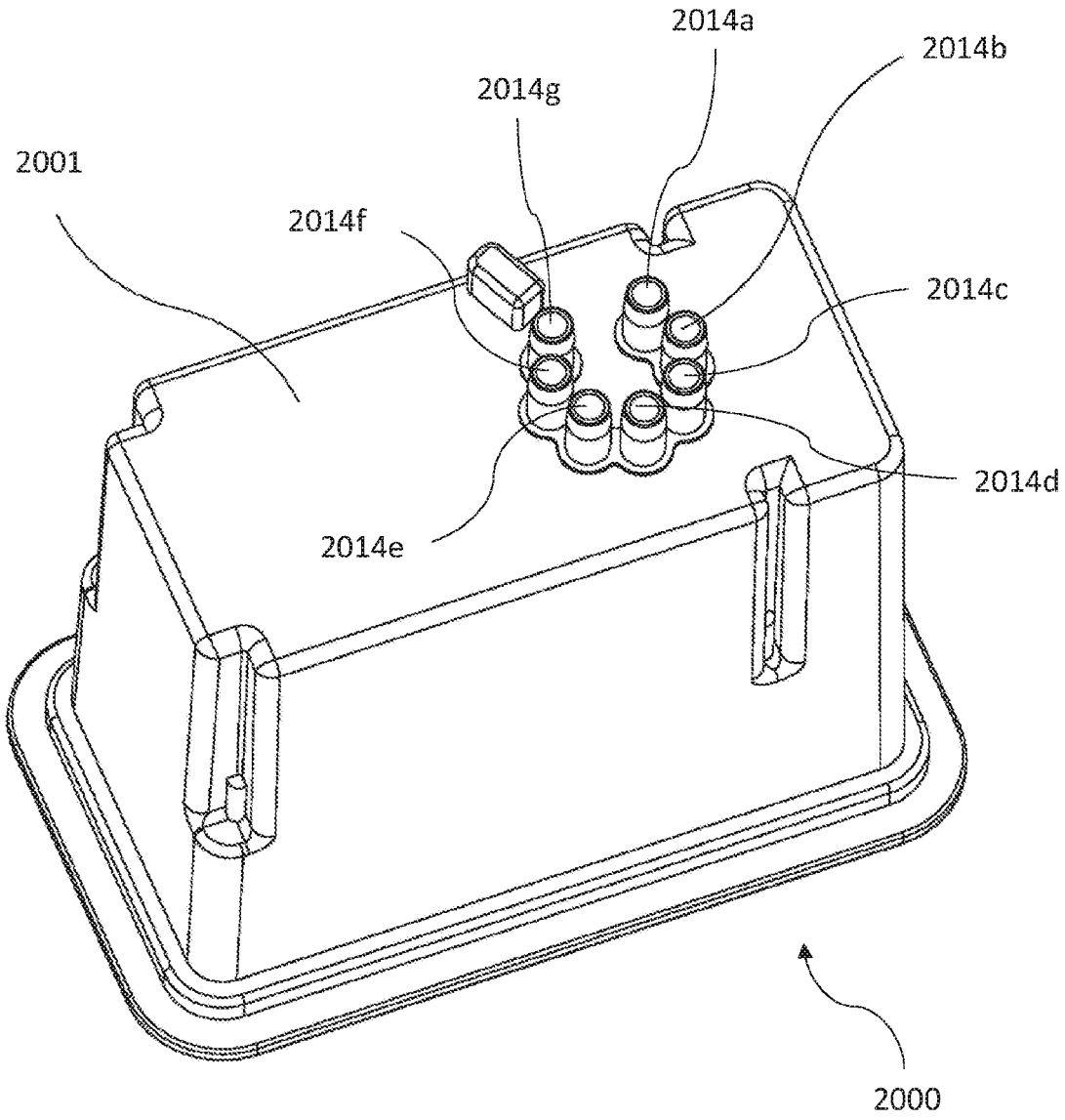
FIG. 12 illustrates a bottom, perspective view of the air pump assembly of FIG. 11, illustrating a plurality of inflation/deflation ports of the second exemplary multichannel air assembly.
Figure 12A:
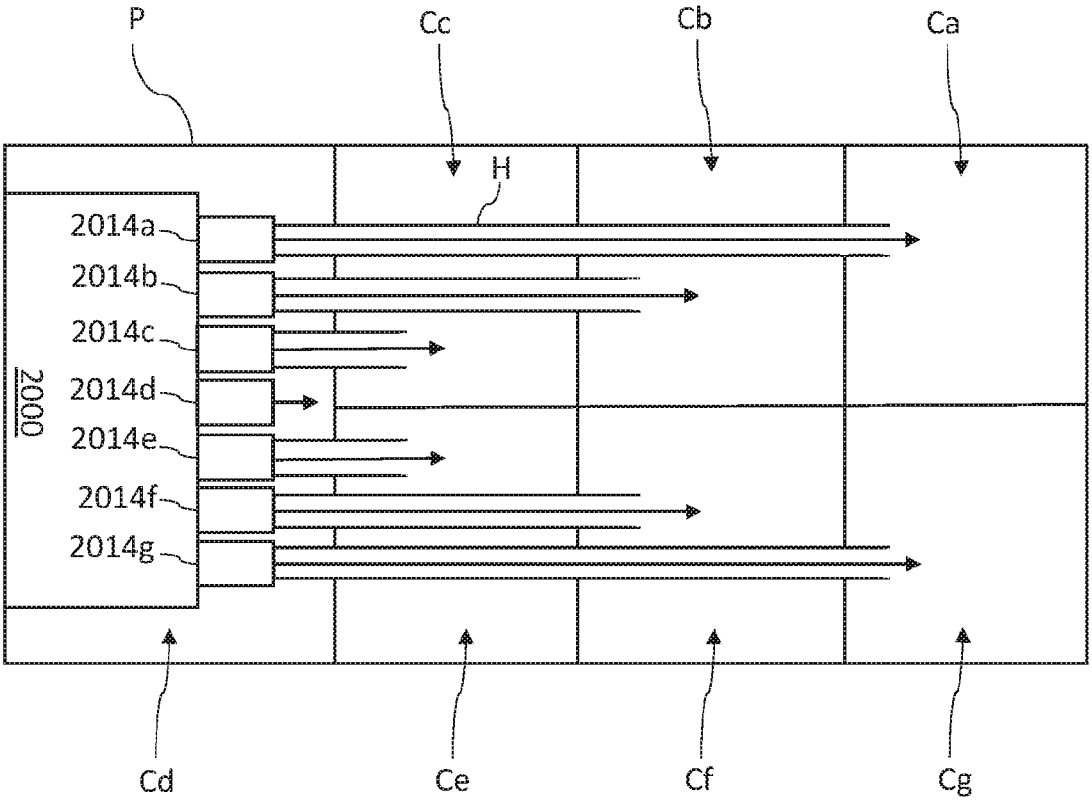
FIG. 12A illustrates a schematic view of the air assembly of FIG. 11 built into an inflatable product having multiple air chambers.
Figure 13:
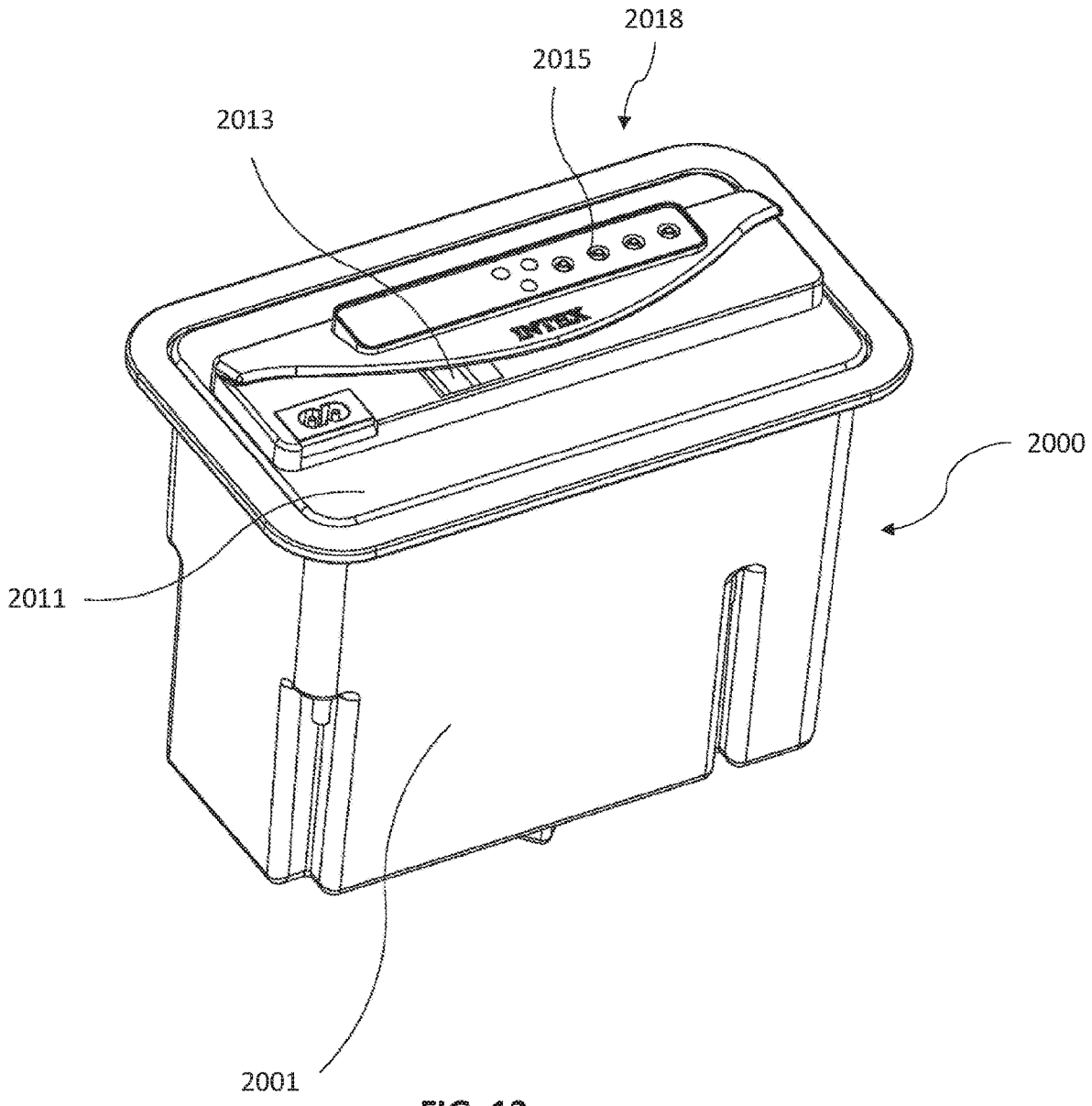
FIG. 13 illustrates a perspective view of the air assembly of FIG. 11, illustrating a control panel of a second exemplary multichannel air pump.
Figure 14:
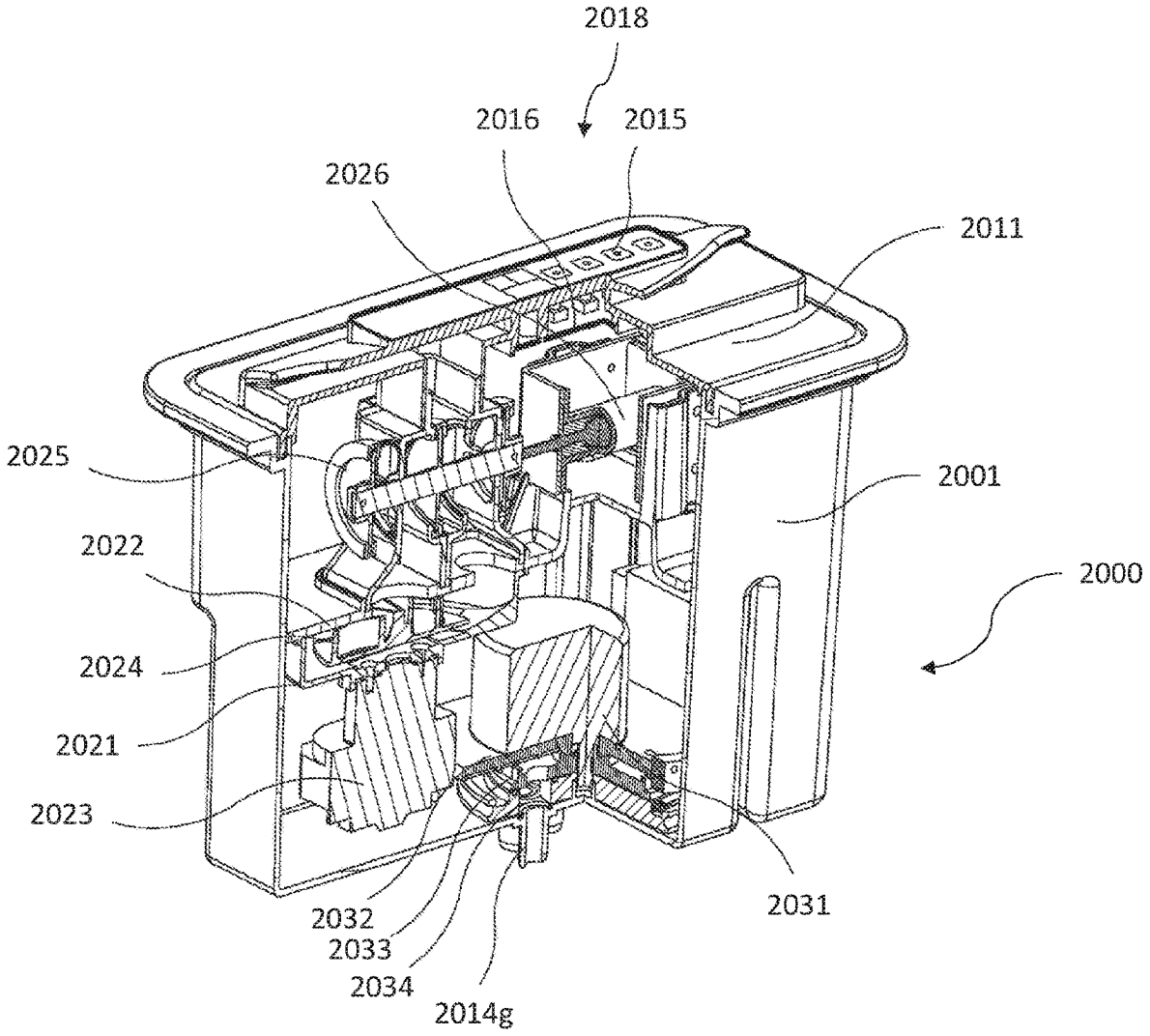
FIG. 14 illustrates a partial cross section view of the air assembly of FIG. 11, illustrating the air pump assembly and the channel switching mechanism of when the channel switching mechanism is in a first position.
Figure 15:
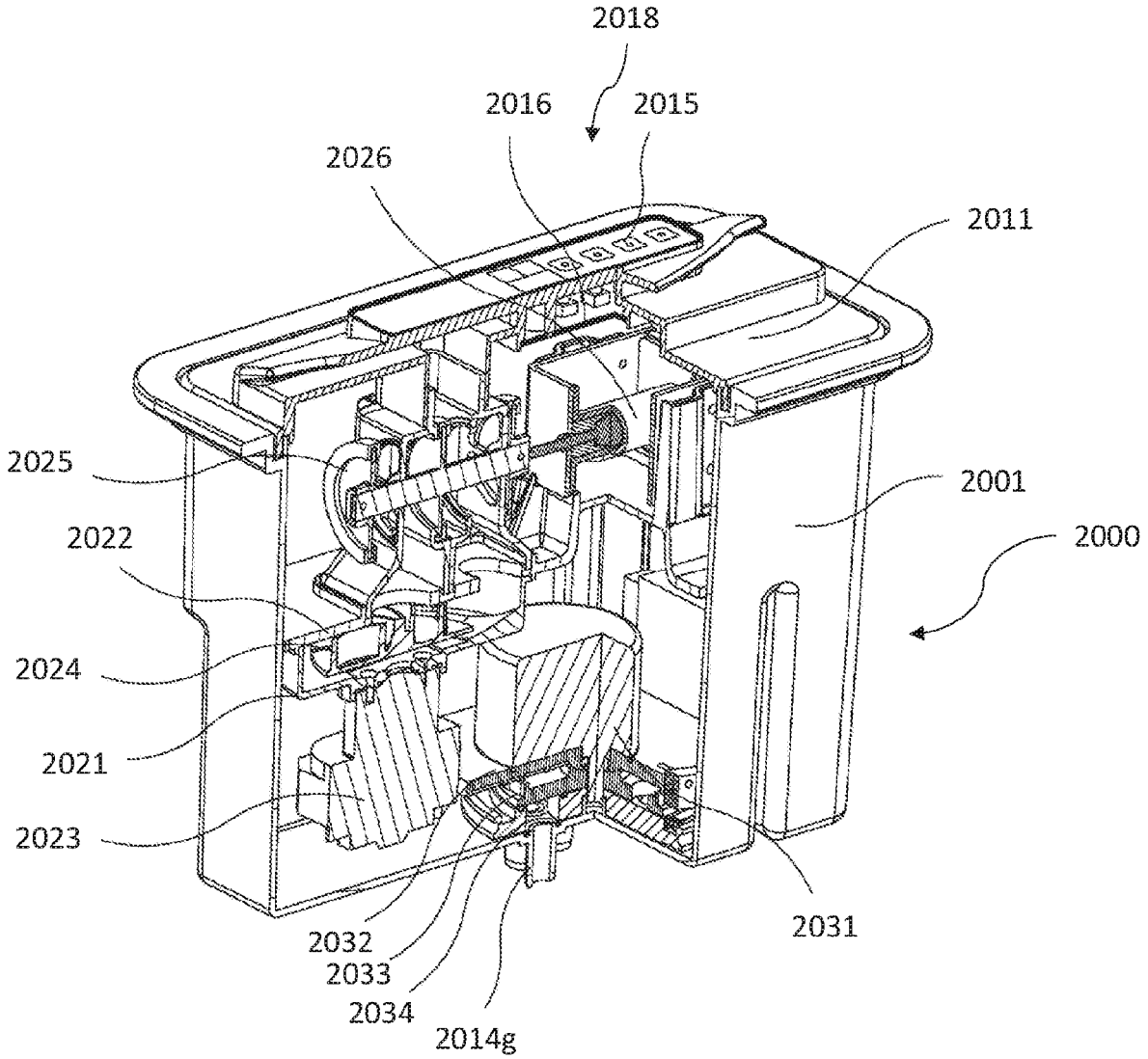
FIG. 15 illustrates a partial cross section view of the air assembly of FIG. 11, illustrating the air pump assembly and the channel switching mechanism when the channel switching mechanism is in a second position.
Figure 16:
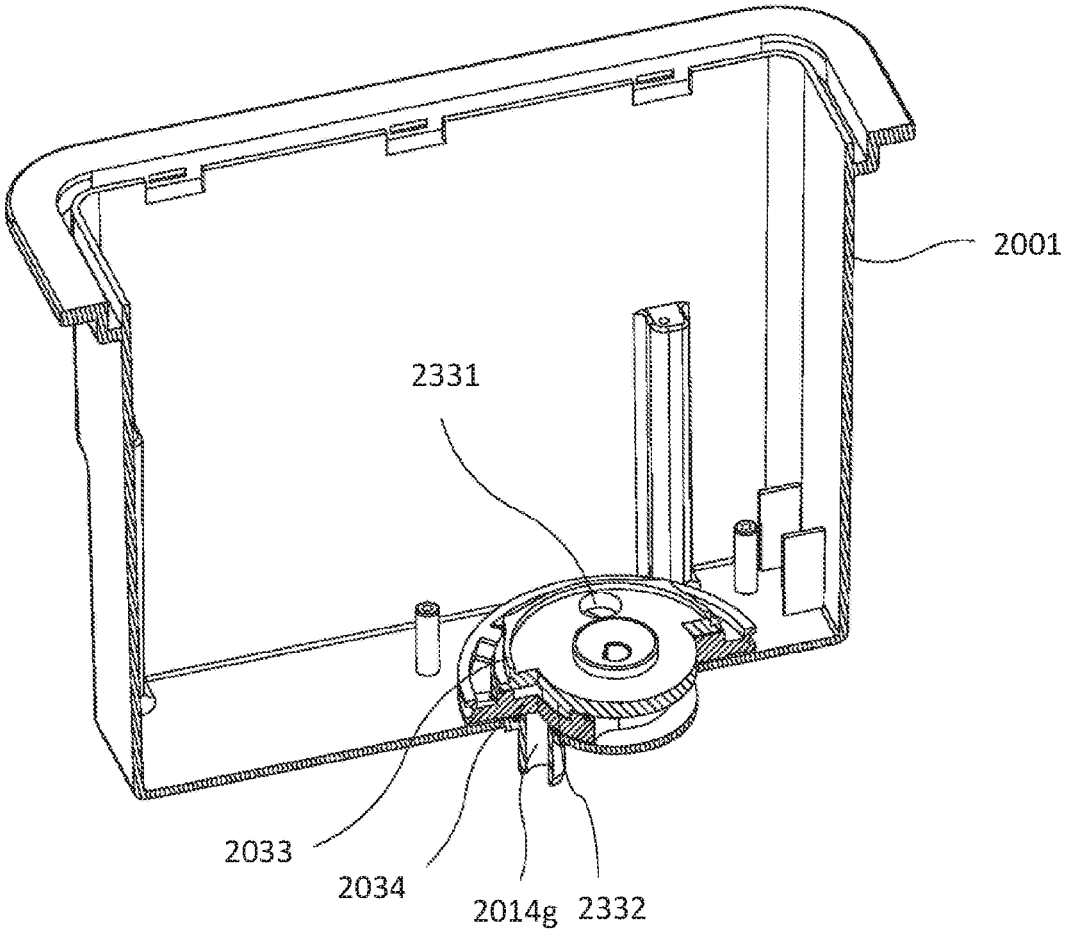
FIG. 16 illustrates a simplified, cross section view of the air assembly of FIG. 11, illustrating the channel switching mechanism when the channel switching mechanism is in a first, sealed switching state.

Referring generally now to FIGS. 11-18, another embodiment of the multichannel air assembly 1000 is disclosed. The multichannel air assembly 2000 has substantially the same structure and operation as the multichannel air assembly 1000, except as described below. Like elements of the multichannel air assembly 2000 are identified by adding "1000" to the corresponding reference number of the multichannel air assembly 1000. The multichannel air assembly 2000 illustratively has seven ports 2014*a-g* (FIG. 12) rather than three. As a result, the multichannel air assembly 2000 may be used to inflate or deflate an inflatable product P (FIG. 12A) having seven corresponding independent air chambers Ca-g via optional hoses H, the air pump assembly 2002, and a channel switching mechanism 2003.

The channel switching mechanism 2003 has substantially the same structure as the channel switching mechanism 1003 of multichannel air assembly 1000. However, in this embodiment, a seal disc 2034 has a circular, single-channel vent hole 2341 (similar to the above-described vent hole 1341) which may be placed in selective communication with a single port 2014*a-g*, as well as an arcuate, multi-channel vent hole 2345 which may be placed in selective communication with more than one (e.g., three) of the ports 2014*a-g* simultaneously, allowing the inflation or deflation of a plurality of chambers Ca-g at one time. As a result, compared to the seal disc 1034, the seal disc 2034 includes additional sensing apertures 2038 corresponding to desired rotary positions of the single-channel vent hole 2341 that allows for a single port 2014*a-g* to be opened at one time and the multi-channel vent hole 2345 that allows for multiple ports 2014*a-g* to be opened at one time.

Figure 17:
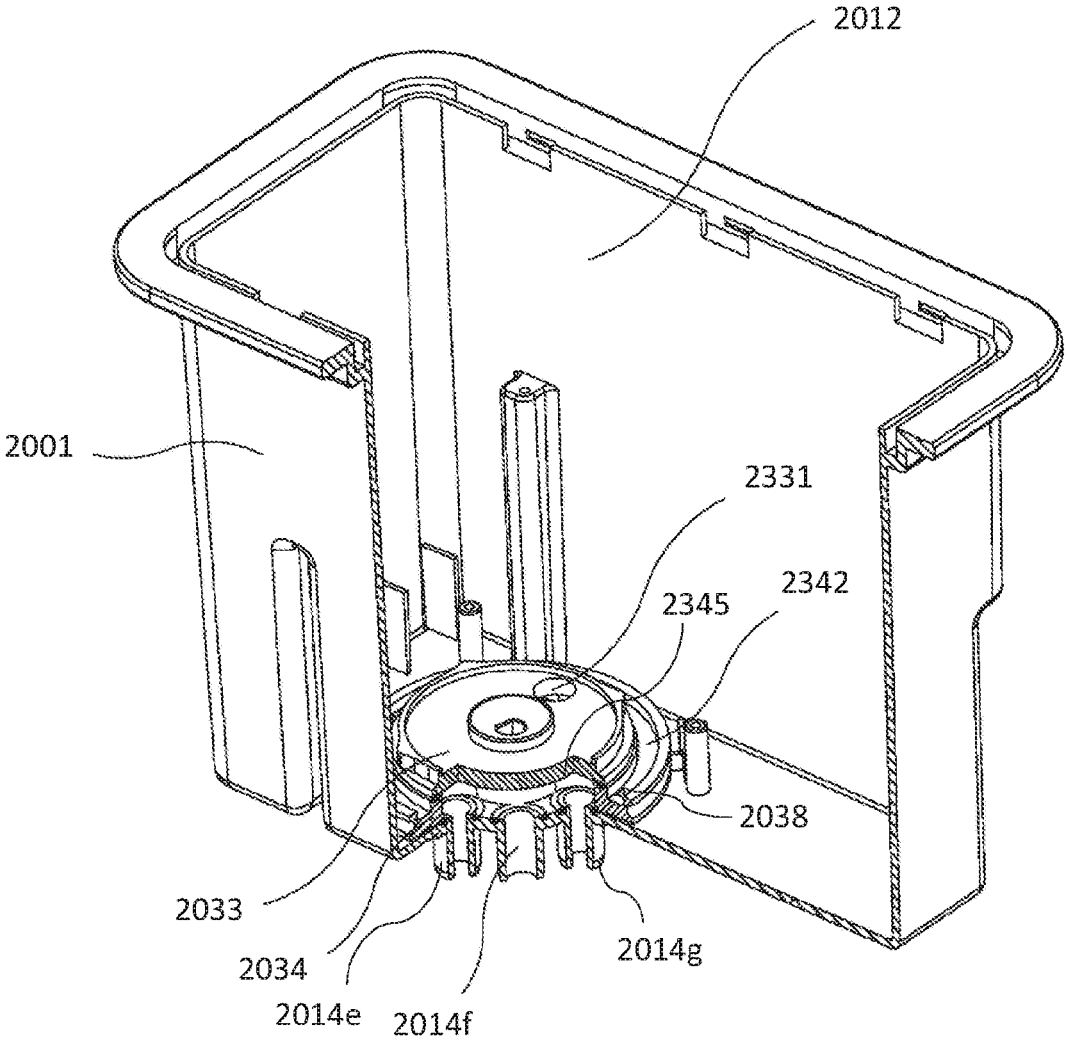
FIG. 17 illustrates a simplified, cross section view of the air assembly of FIG. 11, illustrating the channel switching mechanism when the channel switching mechanism is in a second, partially open switching state.
Figure 18:
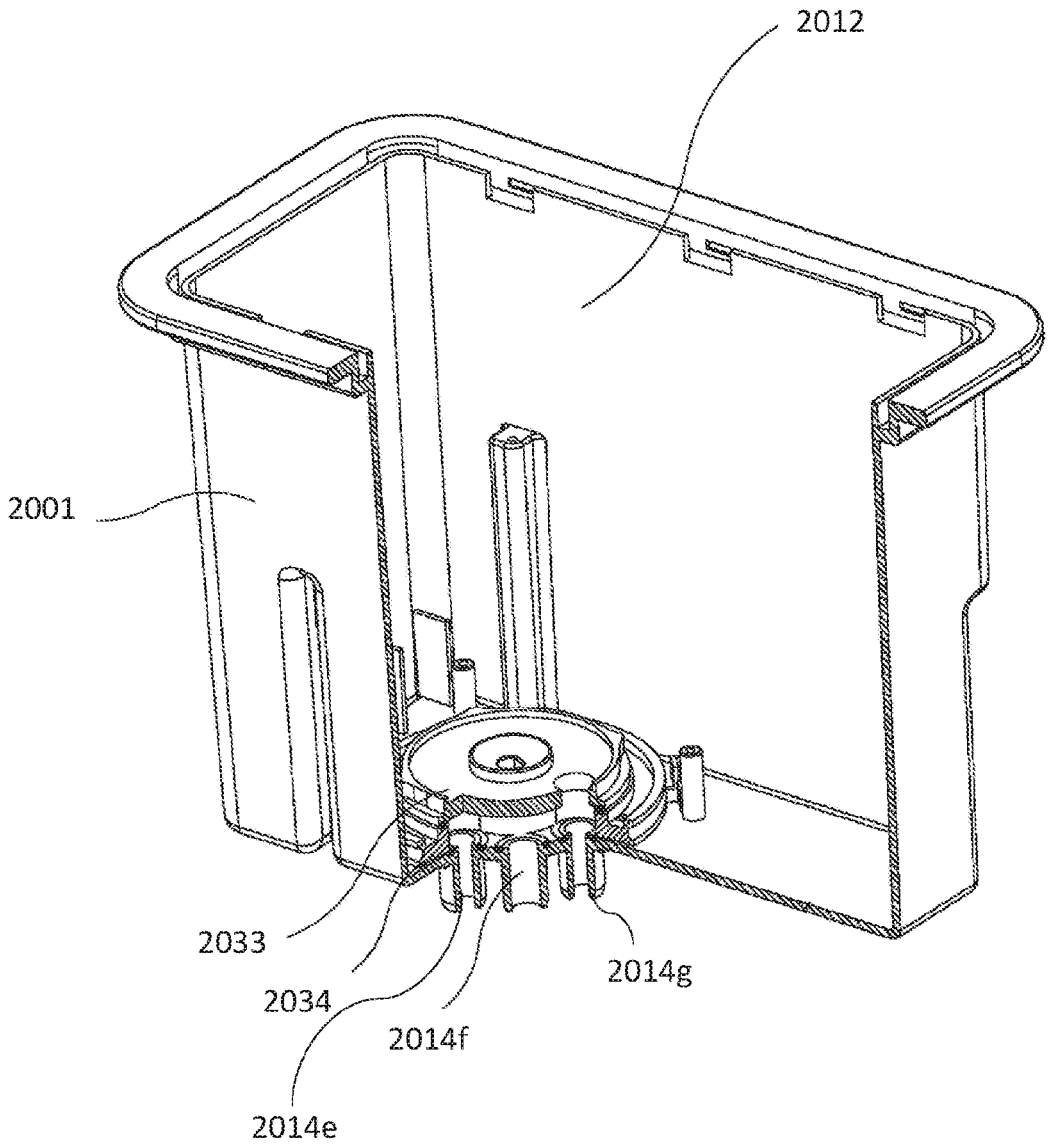
FIG. 18 illustrates a simplified, cross section view of the air assembly of FIG. 11, illustrating the channel switching mechanism when the channel switching mechanism is in a third, fully open switching state.

The operation of the channel switching mechanism 2003 is shown in FIGS. 14-18 and is substantially the same as the operation of the above-described channel switching mechanism 1003. In FIG. 17, the seal disc 1034 is rotated to align the multi-channel vent hole 2345 with the desired ports 2014*e-g*. In FIG. 18, the rotating disc 1033 is also rotated to align the first vent hole 2331 with the desired ports 2014*e-g* for inflation or deflation.

Referring generally to FIGS. 19-23, another embodiment of air assembly 1000 is disclosed. The multichannel air assembly 3000 has substantially the same structure and operation as the multichannel air assembly 1000, except as described below. Like elements of the multichannel air assembly 3000 are identified by adding "2000" to the corresponding reference number of the multichannel air assembly 1000. Like previously discussed embodiments, a multichannel air assembly 3000 may selectively inflate or deflate multiple chambers C of an inflatable product P. Specifically, the multichannel air assembly 3000 includes an air pump assembly 3002, a channel switching mechanism 3003, and an inflation and deflation switching structure 3004, all of which are disposed in a main body chamber 3012 formed by main body 3001.

The bottom of the main body chamber 3012 comprises ports 3014*a* and 3014*b* (FIGS. 19A-23). The port 3014*a* and the port 3014*b* connect to two chambers Ca and Cb (FIG. 19A) respectively of the inflatable product P and include gaskets 3017 (FIG. 19) to prevent leakage of air flow before or after the inflation or deflation states. Opposite the ports 3014*a-b*, main body 3001 forms an opening to the main body chamber 3012. A main body panel 3112 covers the opening to the main body chamber 3012 and includes an air inlet 3121 and an air outlet 3122. A panel seat 3141 is removably coupled to the top of the main body panel 3112 via a snap ring 3131. The top of the panel seat 3141 is coupled to a control panel 3011 and a large gasket 3132. The large gasket 3132 may comprise, for example, rubber or another polymer which allows for a fused connection with the inflatable product P. For example, the inflatable product P may be sandwiched between and welded, adhered, or otherwise connected to the panel seat 3141 and the gasket 3132. The control panel 3011 further includes a control key 3016 operably coupled to a circuit board 3311, which allows a user to control the operation of the multichannel air assembly 3000. The circuit board 3311 is coupled to a sheath 3312, which couples to a sidewall of the main body 3001 to fix the position of the sheath 3312 within the main body chamber 3012.

Still referring to FIGS. 19-24, a pump cover 3041 couples with the sidewall of the main body 3001 to secure the air pump assembly 3002 within the main body chamber 3012. The pump cover 3041 cooperates with a pump body 3043 to form an impeller chamber 3431, which supports an impeller 3042. The pump cover 3041 further defines an air inlet 3411 corresponding to the air inlet 3121 on the main body panel 3112, and an air outlet 3412 corresponding to the air outlet 3122 of the main body panel 3112. The impeller 3042 is coupled to a rotating shaft 3413 (FIG. 19) of a unidirectional air pump motor 3044 through the pump body 3043. The motor 3044 is operably coupled to the circuit board 3311, with the rotating shaft 3413 coupled to the motor 3044 and disposed through the pump body 3043 to connect to the impeller 3042. In operation, when the user inputs a command to control panel 3011 to operate the air pump assembly 3002, the circuit board 3311 operates the motor 3044 to rotate the impeller 3042, which pulls air into the air inlet 3411 and discharges air from the air outlet 3412.

Figure 19:
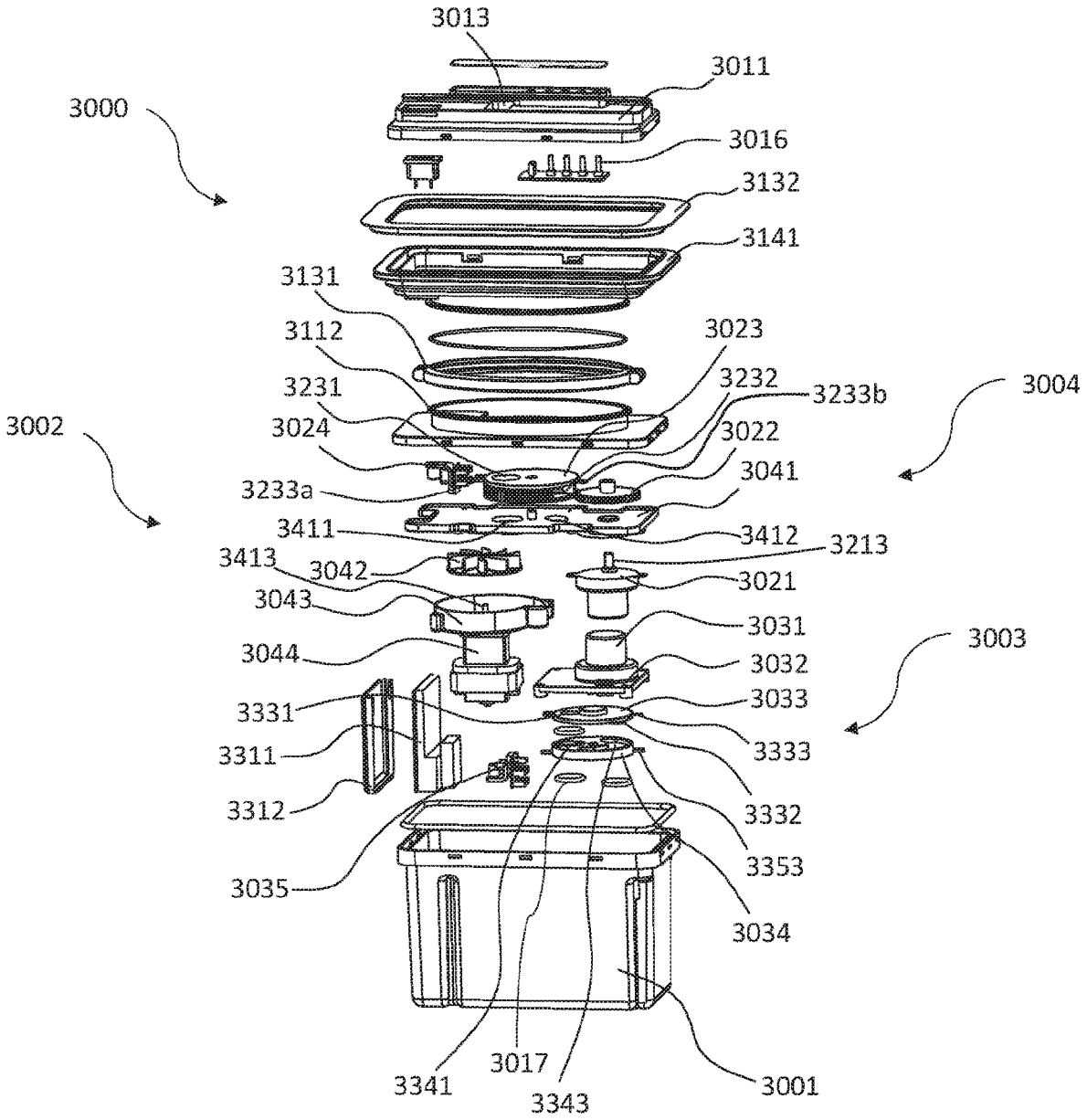
FIG. 19 illustrates an exploded, perspective view of a third exemplary multichannel air assembly, including a main body, an air pump assembly, a channel switching mechanism, and an inflation and deflation switching structure.

Referring specifically to FIG. 19, the multichannel air assembly 3000 also includes the inflation and deflation switching structure 3004, which may also be referred to herein as a directional control structure, located within the main body chamber 3012 and integrated with air pump assembly 3002. The inflation and deflation switching structure 3004 includes a driving gear disc 3022 and a driven gear disc 3023 that engages with the driving disc 3022, both of which are located between the pump cover 3041 and the main body panel 3112 and cooperate to form a switching component. A rotating shaft 3213 of a first bidirectional motor 3021 extends from the first motor 3021, through the pump cover 3041, and couples to the driving gear disc 3022. The first motor 3021 is operably coupled to the circuit board 3311.

The driven gear disc 3023 is coupled to the pump cover 3041 and provided with a first axial vent 3231 and a second L-shaped vent 3232. The first axial vent 3231 comprises two openings on the driven gear disc 3023, with one opening located on an upper end face and one opening located on a lower end face of driven gear disc 3023. The second L-shaped vent 3232 also comprises two openings on the driven gear disc 3023, with one opening located on the lower end face and one opening located on a sidewall of driven gear disc 3023. The sidewall of driven gear disc 3023 is further provided with two sensed blocks 3233*a-b* configured to be detected by a first sensor 3024, which is positioned adjacent to the driven gear disc 3023 and is operably coupled to the circuit board 3311. In certain embodiments, the first sensor 3024 is an induction sensor or an optical sensor, for example.

Referring again to FIGS. 19 and 20-23, channel switching mechanism 3003 is located within main body chamber 3012 above the ports 3014*a* and 3014*b* and includes a bidirectional motor 3031. Bidirectional motor 3031 is coupled to the upper side of an upper cover 3032, which is coupled to a sidewall of the main body 3001 to secure the channel switching mechanism 3003 within the main body chamber 3012. Bidirectional motor 3031 is operably coupled to the circuit board 3311 so that the control key 3016 can control rotation of the bidirectional motor 3031 in either direction through the circuit board 3311.

Channel switching mechanism 3003 further includes a rotating disc 3033 with a first vent 3331 and a seal disc 3034 with a second vent 3341. A rotating shaft 3027 of the bidirectional motor 3031 is coupled to the rotating disc 3033 so that the bidirectional motor 3031 may drive the rotating disc 3033 to rotate in either direction via the rotating shaft 3027 (FIGS. 20-23). The seal disc 3034 interacts with the rotating disc 3033 via an arc-shaped groove 3343 (FIG. 19) and a boss 3332, as described above. The rotating disc 3033 and the seal disc 3034 each comprise sensed blocks 3333 and 3353, respectively, which are configured to be detected by a second sensor 3035, which is located on the respective side edges of the rotating disc 3033 and the seal disc 3034. In certain embodiments, the second sensor 3035 is an induction sensor or an optical sensor, for example. The second sensor 3035 is operably coupled to the circuit board 3311.

Figure 19A:
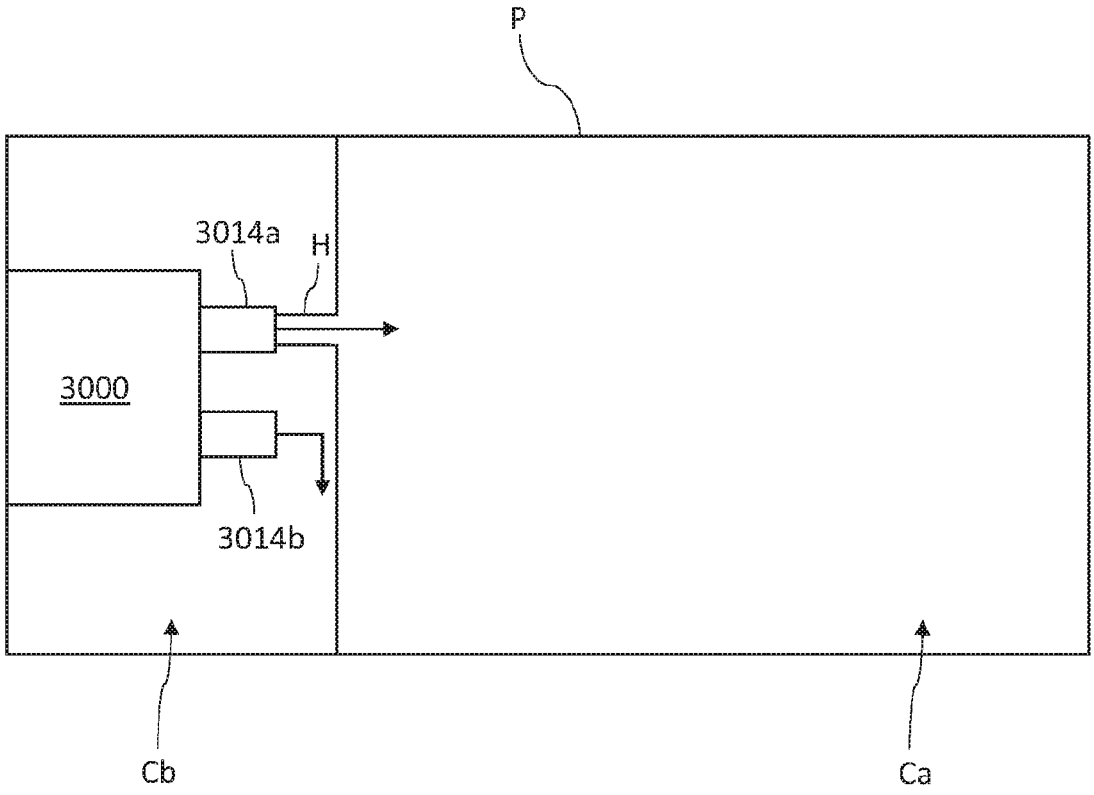
FIG. 19A illustrates a schematic view of the air assembly of FIG. 19 built into an inflatable product having multiple air chambers.
Figure 20:
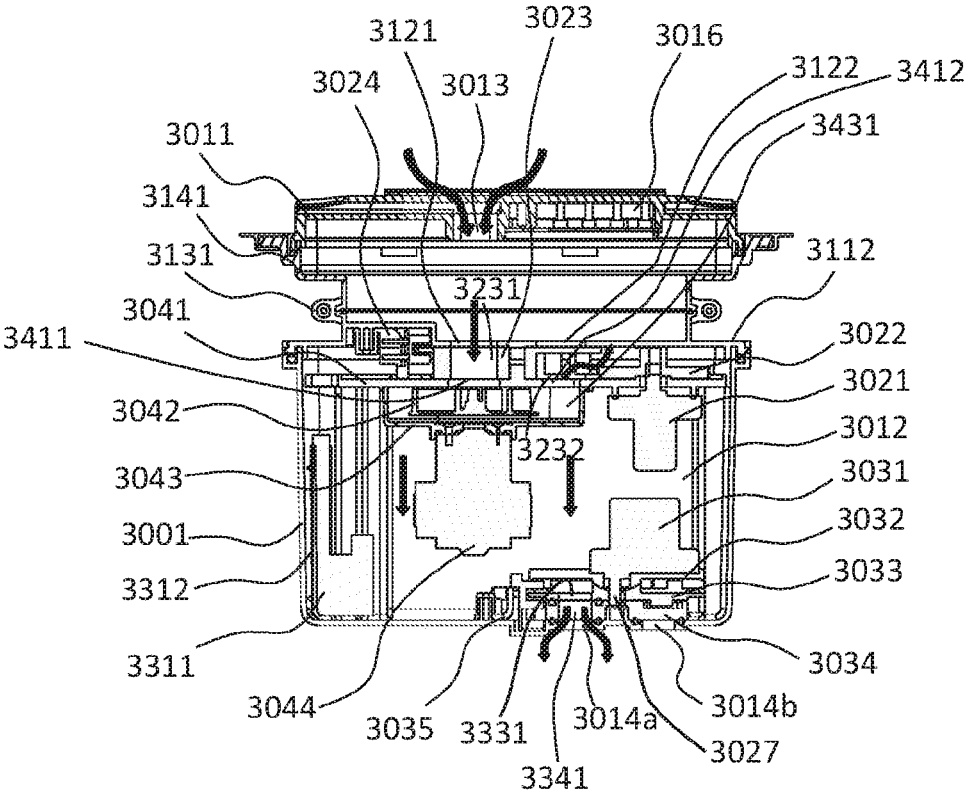
FIG. 20 illustrates a cross section view of the air assembly of FIG. 19, illustrating an inflation state of a first channel.

Referring specifically to FIGS. 19A-20, a user may choose to inflate a chamber Ca of the inflatable product P which is coupled to the port 3014*a* through the control key 3016 of the control panel 3011. At such time, the inflation and deflation switching mechanism 3004 and the channel switching mechanism 3003 are started simultaneously. When the inflation and deflation switching mechanism 3004 starts, the first motor 3021 operates, causing the driving gear disc 3022 to rotate. Next, the driving gear disc 3022 drives the driven gear disc 3023 to rotate until: the first vent 3231 on the driven gear disc 3023 comes into communication with both the air inlet 3411 of the pump cover 3041 and the air inlet 3121 of the main body panel 3112; the second vent 3232 of the driven gear disc 3023 comes into communication with the air outlet 3412 of the pump cover 3041; and the air outlet 3122 of the main body panel 3112 is in a closed state. Also, at this stage, the sensed block 3233*a* on the driven gear disc 3023 is aligned with and detected by the first sensor 3024. Then, the inflation and deflation switching state of the multichannel air assembly 3000 is completed, and the first motor 3021 stops operating. When the channel switching mechanism 3003 starts, the bidirectional motor 3031 operates to rotate the first vent 3331 of the rotating disc 3033 and the second vent 3341 of the seal disc 3034 into alignment with the desired port 3014*a*, as described above. At this inflation stage, the sensed block 3333 on the rotating disc 3033 and the sensed block 3353 on the seal disc 3034 are aligned with and detected by the second sensor 3035.

During or after the above-described operation of the switching mechanism 3004 and the channel switching mechanism 3003, the motor 3044 of the air pump assembly 3002 pump body starts. The motor 3044 drives the impeller 3042 to rotate, so that the impeller 3042 draws external air into vent 3013 of the control panel 3011 and through air inlet 3121 of the main body panel 3112. The impeller 3042 further draws the air through the first vent 3231 of the driven gear disc 3023 and the air inlet 3411 of the pump cover 3041 to be drawn into impeller chamber 3431. The air may then move from the impeller chamber 3431 to main body chamber 3012 through air outlet 3412 of the pump cover 3041 and the second vent 3232 of the driven gear disc 3023. From main body chamber 3012, the air may move through vent 3331 of the rotating disc 3033 and the vent 3341 of the seal disc 3034. The air then is free to enter and inflate the specified chamber Ca of the inflatable product P via the corresponding port 3014*a*.

Figure 21:
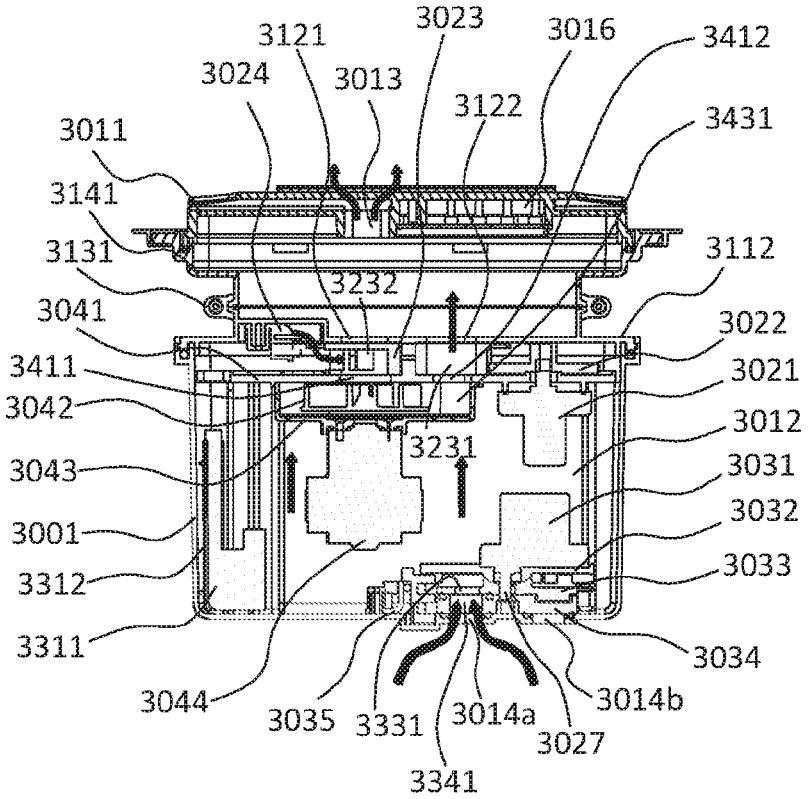
FIG. 21 illustrates a cross section view of the air assembly of FIG. 19, illustrating a deflation state of the first channel.

Otherwise, as shown by FIG. 21 a user may choose to deflate the specified chamber Ca of the inflatable product P (FIG. 19A) coupled to the port 3014*a* via the control key 3016 on the control panel 3011. At such time, the inflation and deflation switching mechanism 3004 and the channel switching mechanism 3003 start simultaneously. When the inflation and deflation switching mechanism 3004 starts, the first motor 3021 operates, causing the driven gear disc 3023 to rotate via the driving gear disc 3022 until: the first vent 3231 on the driven gear disc 3023 comes into communication with the air outlet 3412 of the pump cover 3041 and the air outlet 3122 of the main body panel 3112; the second vent 3232 comes into communication with the air inlet 3411 of the pump cover 3041 and the main body chamber 3012; and the air inlet 3121 of the main body panel 3112 is in a closed state. Also, at this deflation stage, the sensed block 3233*b* on the driven gear disc 3023 is aligned with and detected by the first sensor 3024. Then, the inflation and deflation switching state of the multichannel air assembly 3000 is completed, and the first motor 3021 stops operating. The channel switching operation of the channel switching mechanism 3003 is the same as the channel switching operation completed during inflation such that the first vent 3331 of the rotating disc 3033 and the second vent 3341 of the seal disc 3034 are rotated into alignment with the desired port 3014*a*.

During or after the above-described operation of the switching mechanism 3004 and the channel switching mechanism 3003, the motor 3044 of the pump body 3043 starts. The motor 3044 drives the impeller 3042 to rotate so that the impeller 3042 draws air within the specified chamber Ca of the inflatable product P through port 3014*a*, the vent 3341 of the seal disc 3034, and the vent 3331 of the rotating disc 3033 into main body chamber 3012. The impeller 3042 further draws the air through the second vent 3232 of the driven gear disc 3023 and the air inlet 3411 into impeller chamber 3431. The air may then move from the impeller chamber 3431 through air outlet 3412 of the pump cover 3041, the first vent 3231 of the driven gear disc 3023, the air outlet 3122, and the vent 3013 of the control panel 3011 into the surrounding environment to deflate the specified chamber Ca of the inflatable product P.

Figure 22:
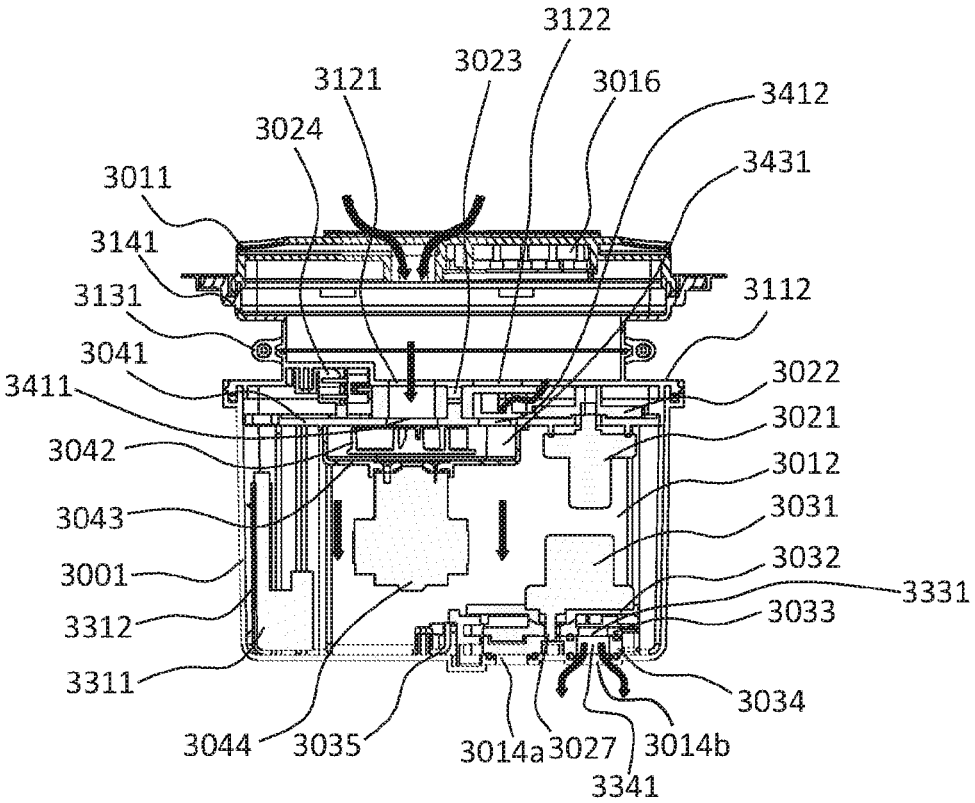
FIG. 22 illustrates a cross section view of the air assembly of FIG. 19, illustrating an inflation state of a second channel.
Figure 23:
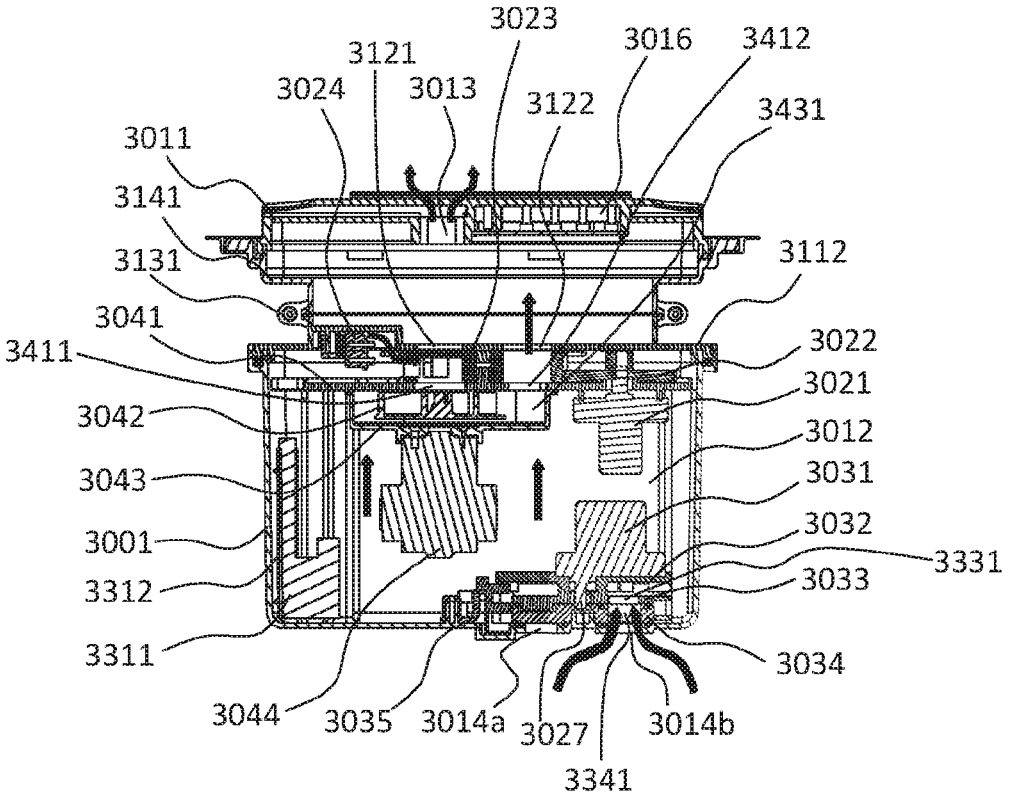
FIG. 23 illustrates a cross section view of the air assembly of FIG. 19, illustrating a deflation state of the second channel.

Referring to FIGS. 21-22, a user may choose to inflate or deflate the chamber Cb of the inflatable product P connected to the port 3014*b* via the control key 3016 on the control panel 3011. At such time, an operation principle similar to operation of inflation or deflation the chamber Ca through the port 3014*a* is utilized. However, during operation of the channel switching mechanism 3003, the first vent 3331 of the rotating disc 3033 and the second vent 3341 of the seal disc 3034 are rotated into alignment with the other port 3014*b*, as described above. At this stage, the opposing sensed block 3333 on the rotating disc 3033 and the opposing sensed block 3353 on the seal disc 3034 are aligned with and detected by the second sensor 3035.

The main body 3001 may also be provided with more than two ports 3014; correspondingly, it would be necessary to dispose more than two sensed blocks on each of the rotating disc 3033 and the seal disc 3034 of the channel switching mechanism 3003.

Referring generally to FIGS. 24-28, yet another embodiment of the multichannel air assembly 4000 is disclosed. The multichannel air assembly 4000 has substantially the same structure and operation as the multichannel air assembly 1000, except as described below. Like elements of the multichannel air assembly 4000 are identified by adding "3000" to the corresponding reference number of the multichannel air assembly 1000. Like previous embodiments, multichannel air assembly 4000 has both an inflation and deflation state and includes an air pump assembly 4002, an inflation and deflation switching mechanism 4004, and a channel switching mechanism 4003 disposed in a main body chamber 4012 formed by main body 4001.

The main body 4001 and the main body chamber 4012 of multichannel air assembly 4000 are structured similar to the main body 3001 and the main body chamber 3012 of the multichannel air assembly 3000 and are not described here in further detail, except that main body panel 4112 contains one combined inlet/outlet 4121 (FIG. 24) (rather than an inlet 3121 with a separate outlet 3122 as with main body panel 3112 of multichannel air assembly 3000). The channel switching structure 4003 is also structured similarly to and operates the same as the channel switching structure 3003 and so is not described here in further detail.

Still referring to FIGS. 24-28, a pump cover 4041 couples with the sidewall of the main body 4011 to secure the air pump assembly 4002 within the main body chamber 4012. The pump cover 4041 cooperates with a pump body 4043 to form an impeller chamber 4431, which supports an impeller 4042. The pump cover 4041 further defines an air inlet 4411 and an air outlet 4412. The impeller 4042 is coupled to a rotating shaft 4413 (FIG. 24) of a unidirectional air pump motor 4044, through the pump body 4043. The motor 4044 is operably coupled to the circuit board 4311, with the rotating shaft 4413 extending from the motor 4044 and through the pump body 4043 to connect to the impeller 4042. In operation, when the user inputs a command to control panel 4011 to operate the air pump assembly 4002, the circuit board 4311 operates the motor 4044 to rotate the impeller 4042, which pulls air into the air inlet 4411 and discharges air from the air outlet 4412.

Figure 24:
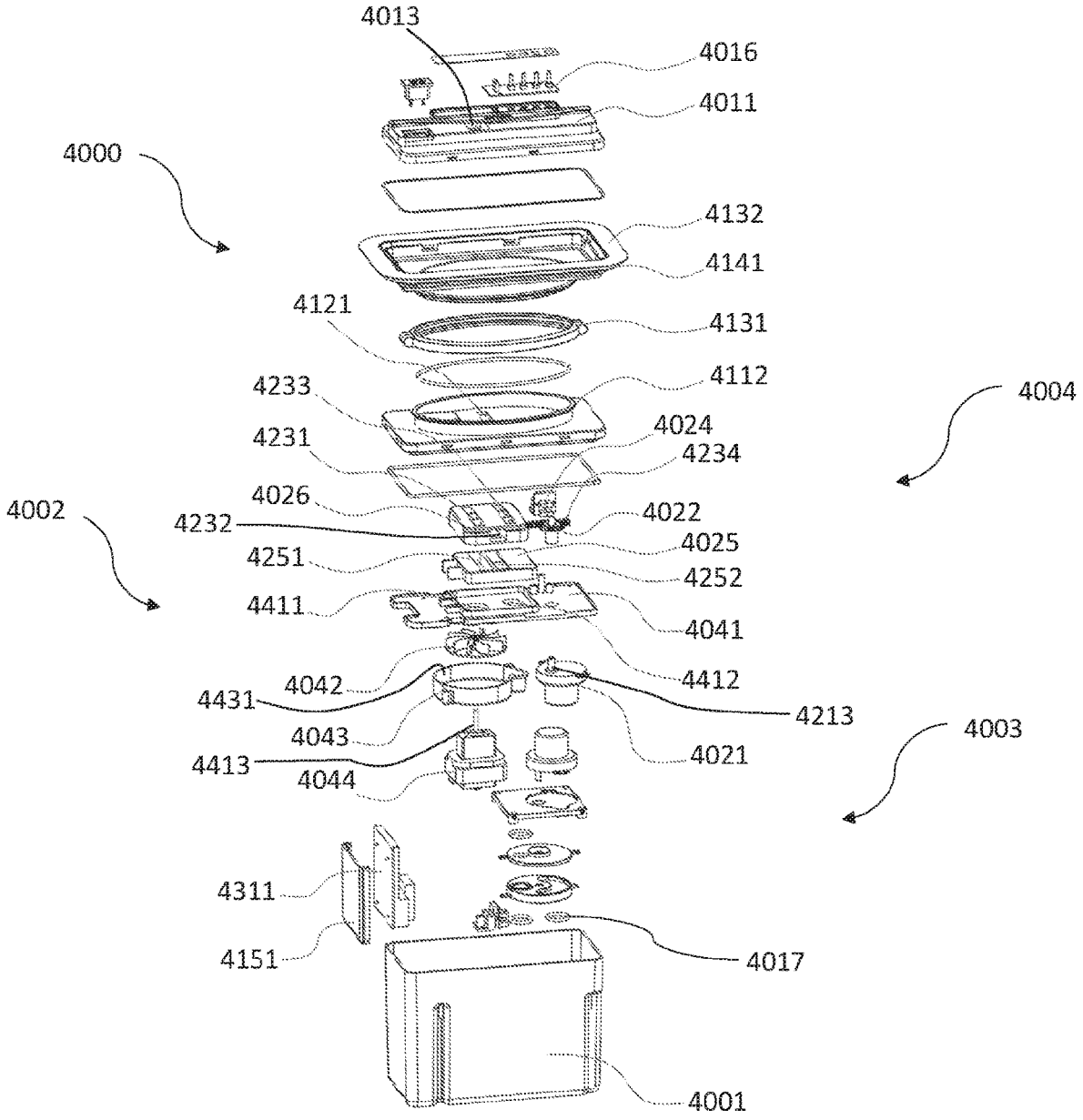
FIG. 24 illustrates an exploded, perspective view of a fourth exemplary multichannel air assembly, including a main body, an air pump assembly, a channel switching mechanism, and an inflation and deflation switching structure.

Referring specifically to FIG. 24, the multichannel air assembly 4000 also includes an inflation and deflation switching structure 4004, which may also be referred to herein as a directional control structure, located within the main body chamber 4012 and integrated with air pump assembly 4002. The inflation and deflation switching structure 4004 includes a driving gear disc 4022 and a translating valve 4026, both of which are located between the pump cover 4041 and main body panel 4112 and cooperate to form a switching component. A rotating shaft 4213 of a bidirectional motor 4021 extends through pump cover 4041 and couples to the driving gear disc 4022. The motor 4021 is operably coupled to the circuit board 4311.

The translating valve 4026 is coupled to the driving gear disc 4022 through a rack 4234 and is provided with a fifth vent 4231, a sixth vent 4232, and a seventh vent 4233. The sixth vent 4232 of the translating valve 4026 is disposed between the fifth vent 4231 and the seventh vent 4233 and is L-shaped, with one opening of the sixth vent 4232 located on a lower end face of the translating valve 4026, and the other opening of the sixth vent 4232 located on a side end face of the translating valve 4026. One opening of the fifth vent 4231 is located on an upper end face of the translating valve 4026, and the other opening of the fifth vent 4231 is located on the lower end face of the translating valve 4026. One opening of the seventh vent 4233 is located on the upper end face of the translating valve 4026, and the other opening of the seventh vent 4233 is located on the lower end face of the translating valve 4026.

A sensor 4024 is located on a side edge of rack 4234 and is operably connected to circuit board 4311. In certain embodiments, the sensor 4024 is an induction sensor or an optical sensor, for example. Rack 4234 includes at least one sensed block (not shown) configured for detection by the sensor 4024. Additionally, a cover plate 4025 may be placed between the translating valve 4026 and the pump cover 4041. The cover plate 4025 includes an eighth vent 4251, which couples to the air inlet 4411 of pump cover 4041, and a ninth vent 4252, which couples to the air outlet 4412 of the pump cover 4041.

Figure 25:
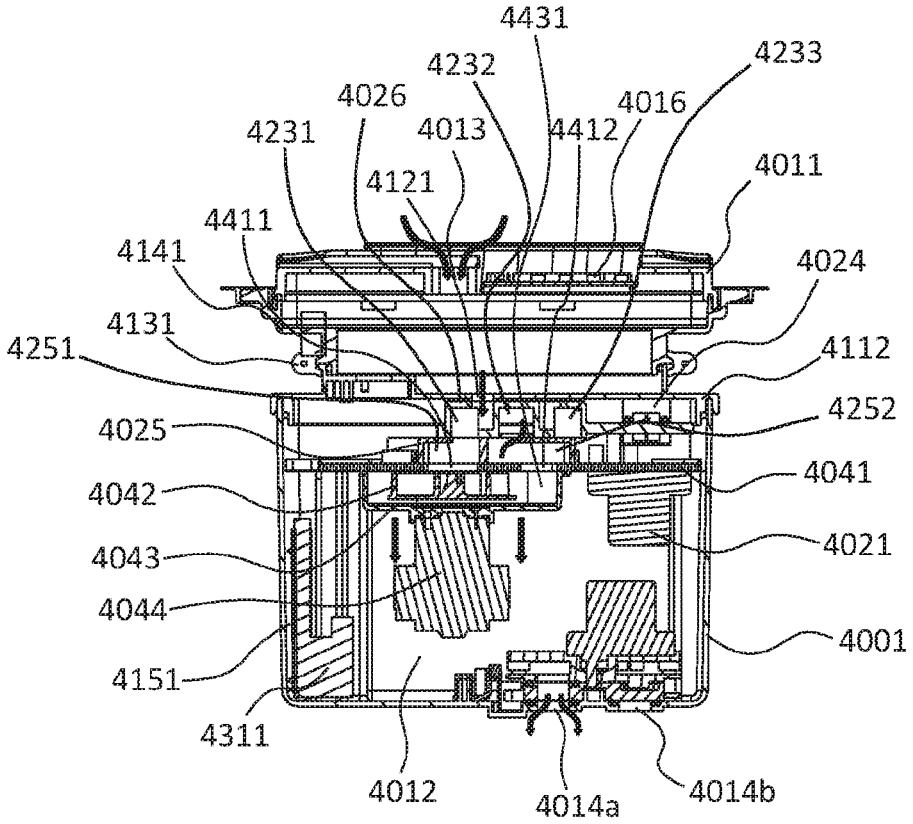
FIG. 25 illustrates a cross section view of the air assembly of FIG. 24, illustrating an inflation state of a first channel.

Referring to FIGS. 24-25, a user may choose to inflate a specified chamber Ca of the inflatable product P which is coupled to the port 4014*a* by using the control key 4016 of the control panel 4011. At such time, the inflation and deflation switching mechanism 4004 and the channel switching mechanism 4003 start simultaneously. When the inflation and deflation switching mechanism 4004 starts, the motor 4021 operates, causing the driving gear disc 4022 to rotate. Next, the driving gear disc 4022 drives the rack 4234, which moves the translating valve 4026 until both the fifth vent 4231 on the translating valve 4026 comes into communication with the inlet/outlet 4121 (FIG. 24) of the main body panel 4112, the eighth vent 4251 of cover plate 4025, and air inlet 4411 of pump cover 4041, and the sixth vent 4232 of translating valve 4026 comes into communication with air outlet 4412 of pump cover 4041 through ninth vent 4252. At this time, the sensed block (not shown) on the rack 4234 may be aligned with and detected by the sensor 4024. Then inflation and deflation switching state of air assembly 4000 is completed, and motor 4021 stops operation. The channel switching mechanism 4003 also starts and completes the same operation as is detailed above for the multichannel air assembly 3000, and so is not described here in further detail.

During or after the above-described operation of the switching mechanism 4004 and the channel switching mechanism 4003, the specified port 4014*a* is in communication with the main body chamber 4012, and the motor 4044 of the air pump assembly 4002 starts. The motor 4044 drives impeller 4042 to rotate, so that the impeller 4042 draws external air into a vent 4013 of a control panel 4011, through inlet/outlet 4121 (FIG. 24) of main body panel 4112, through fifth vent 4231 of translating valve 4026, through eighth vent 4251 of cover plate 4025, and into impeller chamber 4431 through inlet 4411 of pump cover 4041. The air may then move from the impeller chamber 4431 to main body chamber 4012 through air outlet 4412 of pump cover 4041, ninth vent 4252 of cover plate 4025, and fifth vent 4231 of translating valve 4026. From main body chamber 4012, the air may move through channel switching mechanism 4003, and is then free to enter and inflate the specified chamber Ca of the inflatable product P via the corresponding port 4014*a*.

Figure 26:
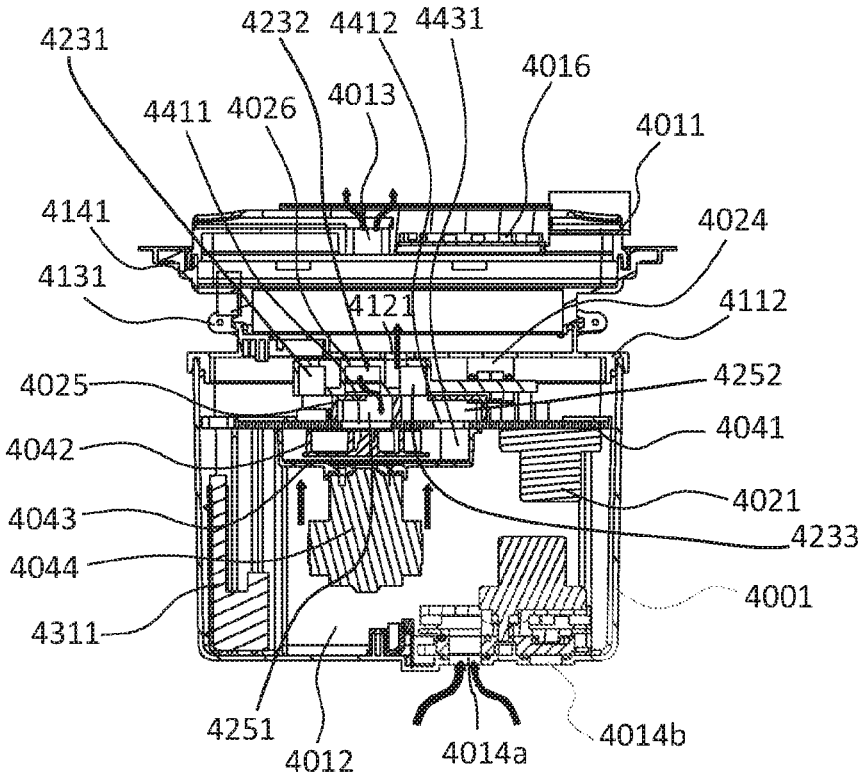
FIG. 26 illustrates a cross section view of the air assembly of FIG. 24, illustrating a deflation state of the first channel.

Otherwise, as shown in FIG. 26, a user may choose to deflate the specified chamber Ca of the inflatable product P (FIG. 24A) coupled to the port 4014*a* via the control key 4016 of the control panel 4011. At such time, the inflation and deflation switching mechanism 4004 and the channel switching mechanism 4003 start simultaneously. When inflation and deflation switching mechanism 4004 starts, the motor 4021 operates, causing the driving gear disc 4022 to rotate. Next, the driving gear disc 4022 drives the rack 4234, which moves the translating valve 4026 until both the sixth vent 4232 on the translating valve 4026 comes into communication with the eighth vent 4251 of the cover plate 4025 and the air inlet 4411 of the pump cover 4041, and the seventh vent 4233 comes into communication with the air outlet 4412 of the pump cover 4041, the ninth vent 4252 of the cover plate 4025, and the inlet/outlet 4121 (FIG. 24) on the main body panel 4112. Also, at this stage, the sensed block (not shown) on the rack 4234 may be aligned with and detected by the sensor 4024. Then the inflation and deflation switching operation of the multichannel air assembly 4000 is completed and motor 4021 stops operating.

Figure 24A:
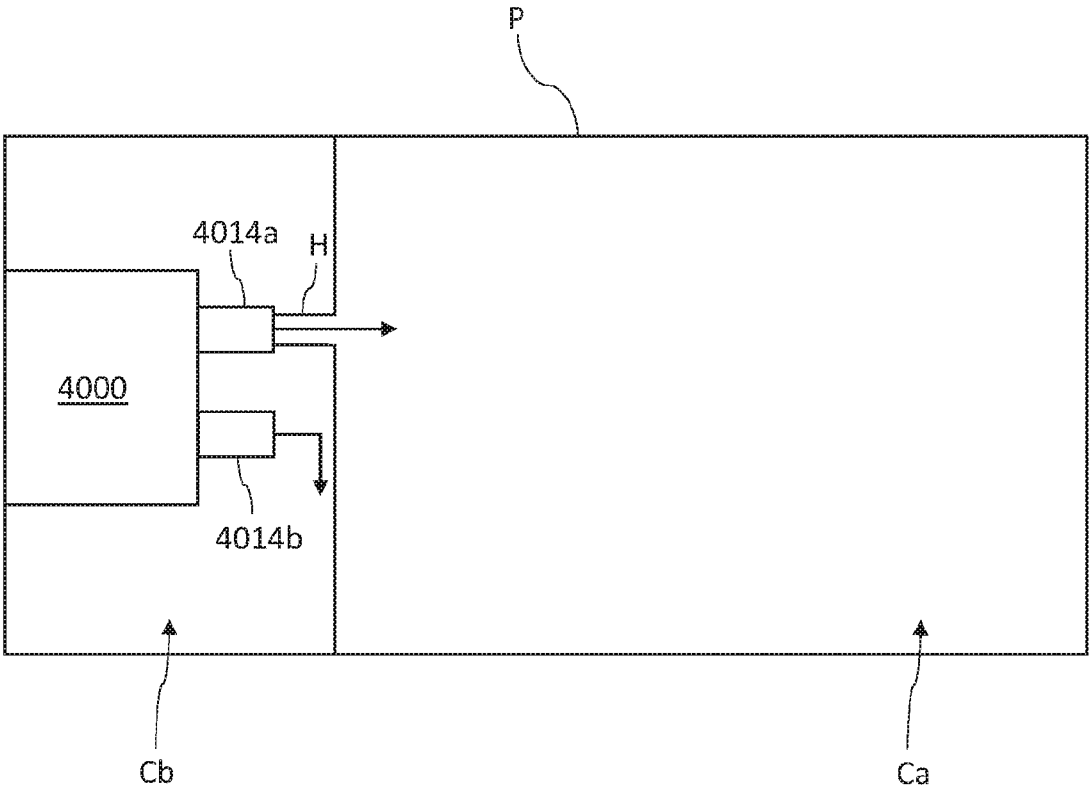
FIG. 24A illustrates a schematic view of the air assembly of FIG. 11 built into an inflatable product having multiple air chambers.

During or after the above-described operation of the switching mechanism 4004 and the channel switching mechanism 4003, the motor 4044 of the air pump assembly 4002 starts. The motor 4044 drives the impeller 4042 to rotate so that the impeller 3042 draws air within the specified chamber Ca of the inflatable product P (FIG. 24A) through the port 4014*a* and through the channel switching structure 4003 into the main body chamber 4012. The impeller 4042 further draws air through the sixth vent 4232 of the translating valve 4026, through the eighth vent 4251 of the cover plate 4025, and through the air inlet 4411 of the pump cover 4041 to enter the impeller chamber 4431. The air may then move from the impeller chamber 4431 through the air outlet 4412 of the pump cover 4041, through the ninth vent 4252 of cover plate 4025 through the seventh vent 4233 of translating valve 4026, through the inlet/outlet 4121 (FIG. 24) of main body panel 4112, and the vent 4013 of the control panel 4011 into the surrounding environment to deflate the specified chamber Ca of the inflatable product P (FIG. 24A).

Figure 27:
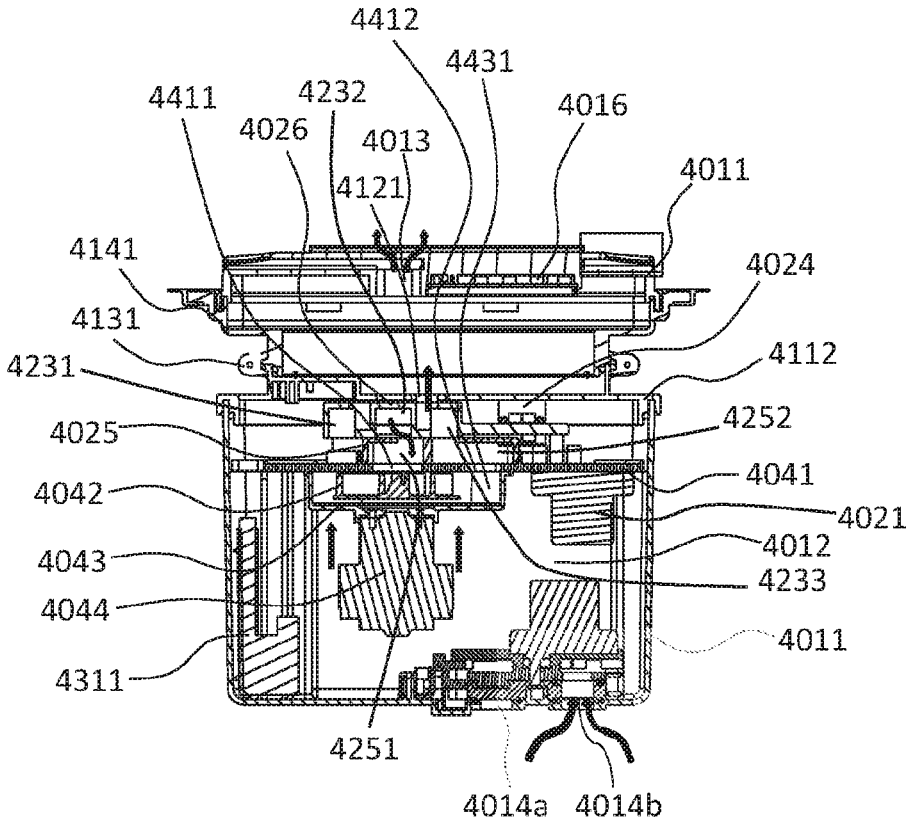
FIG. 27 illustrates a cross section view of the air assembly of FIG. 24, illustrating a deflation state of a second channel.
Figure 28:
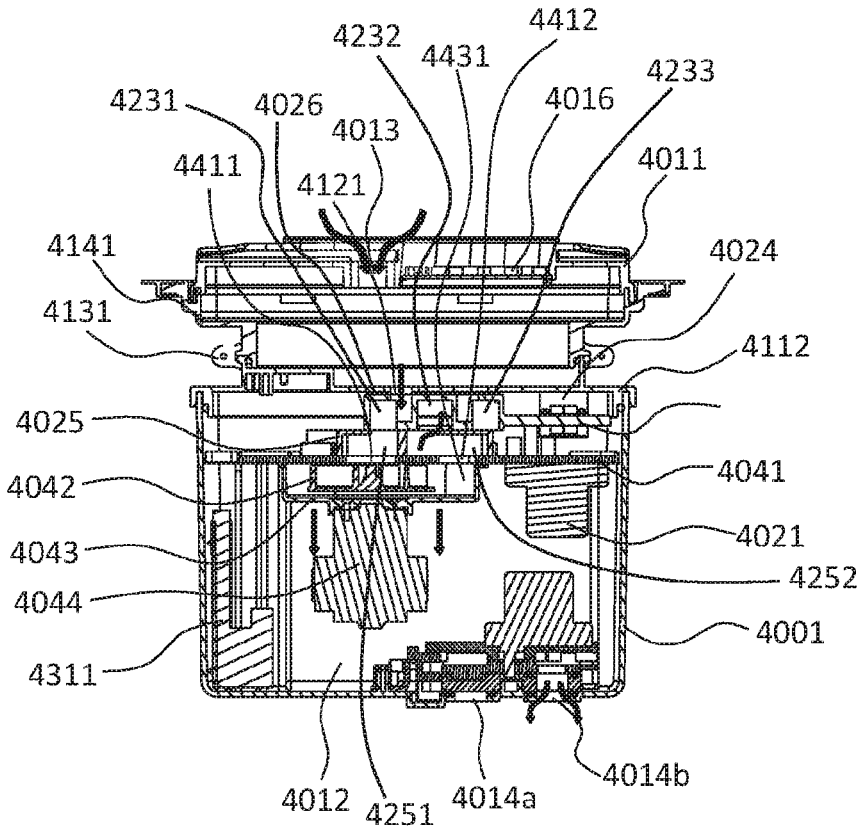
FIG. 28 illustrates a cross section view of the air assembly of FIG. 24, illustrating an inflation state of the second channel.

Referring to FIGS. 27-28, a user may also choose to inflate or deflate the specified chamber Cb of the inflatable product P which is connected to the port 4014*b* via the control key 4016 on the control panel 4011. At such time, an operation principle is similar to that of the operations of inflating or deflating a specified chamber through first port 4014*a*, and the details are not described here again. The difference lies in that second port 4014*b* is communicated with main body chamber 4012 through channel switching structure 4003, as described in connection with multichannel air assembly 3000 above.

Various features of the above-described multichannel air assemblies 1000-4000 may be selectively combined. For example, the multi-channel vent hole 2345 of the second multichannel air assembly 2000 may be incorporated into any of the other pumps.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A multichannel air assembly for use with an inflatable product having at least a first chamber and a second chamber, the air assembly comprising:

a main body forming a main body chamber and further comprising a first vent in communication with a surrounding environment, a first port in communication with the first chamber, and a second port in communication with the second chamber;

a control coupled to the main body;

a channel selector disposed in the main body and operably coupled to the control, the channel selector configured to place the main body chamber in selective communication with a selected one of the first and second ports, the channel selector comprising:

a motor comprising a rotating shaft;

a first rotating disc fixedly coupled to the rotating shaft, the first rotating disc comprising a first vent hole in communication with the main body chamber; and a second rotating disc coupled to the first rotating disc, the second rotating disc comprising a second vent hole in selective communication with the selected port and the first vent hole; and an air pump assembly disposed in the main body in communication with the first vent and operably coupled to the control, the air pump assembly operable in:

an inflation state in which the air pump assembly directs air from the surrounding environment to the selected port to inflate the corresponding chamber of the inflatable product; and a deflation state in which the air pump assembly directs air from the selected port to the surrounding environment to deflate the corresponding chamber of the inflatable product.

2. The air assembly of claim 1, the first rotating disc further comprising a boss and the second rotating disc further comprising a groove configured to receive the boss, wherein the first rotating disc moves relative to the second rotating disc when the boss moves within the groove, and wherein the first rotating disc moves together with the second rotating disc when the boss reaches an end of the groove.

3. The air assembly of claim 1, the channel selector further comprising:

at least one first signal switch configured to detect a rotary position of the first rotating disc; and at least one second signal switch configured to detect a rotary position of the second rotating disc.

4. The air assembly of claim 3, wherein at least one protrusion is coupled to a periphery of the first rotating disc to selectively contact the at least one first signal switch.

5. The air assembly of claim 3, the second rotating disc further comprising an annular groove with a positioning point to selectively contact the at least one second signal switch.

6. The air assembly of claim 1, further comprising an upper cover supporting the motor and coupled to a sidewall of the main body.

7. The air assembly of claim 3, wherein the motor, the at least one first signal switch, and the at least one second signal switch are operably coupled to a circuit board, the circuit board operably coupled to the control.

8. The air assembly of claim 1, further comprising a panel coupled to the main body to cover an opening in the main body, wherein the panel defines the first vent and supports the control.

9. The air assembly of claim 1, the air pump assembly comprising:

a pump body;

a pump cover cooperating with the pump body to form an impeller chamber;

an impeller disposed in the impeller chamber; and an air pump motor coupled to the impeller;

wherein the impeller chamber communicates with the first vent and the main body chamber.

10. The air assembly of claim 9, the air pump assembly further comprising a directional control valve that directs air from the surrounding environment to an inlet of the impeller in the inflation state and directs air from the selected port to the inlet of the impeller in the deflation state.

11. The air assembly of claim 10, wherein:

the pump cover comprises a third vent hole and a fourth vent hole communicatively coupled to the impeller chamber;

the directional control valve comprises:

a first air duct communicatively coupled to the first vent;

a second air duct communicatively coupled to the third vent hole; and a third air duct communicatively coupled to the fourth vent hole;

wherein the first air duct communicates with the second air duct through a first air hole and the second air duct communicates with the main body chamber through a second air hole;

wherein the first air duct communicates with the third air duct through a third air hole and the third air duct communicates with the main body chamber through a fourth air hole;

a first baffle selectively covering the first air hole or the third air hole in the first air duct;

a second baffle selectively covering the second air hole in the second air duct; and a third baffle selectively covering the fourth air hole in the third air duct;

a connecting shaft that supports the first baffle, the second baffle, and the third baffle; and a solenoid valve operatively coupled to the connecting shaft.

12. The air assembly of claim 11, the directional control valve comprising:

a motor;

a driving gear operatively coupled to the motor; and a translating valve with a rack driven by the driving gear.

13. A multichannel air assembly for use with an inflatable product having at least a first chamber and a second chamber, the air assembly comprising:

a main body including a first port in communication with the first chamber and a second port in communication with the second chamber;

a channel switching mechanism disposed in the main body and comprising a first rotating disc with a first vent hole and a second rotating disc with a second vent hole, the channel switching mechanism having:

a first state in which the first and second rotating discs close the first and second ports;

a second state in which the second vent hole in the second rotating disc partially opens a selected one of the first and second ports; and a third state in which the first vent hole in the first rotating disc and the second vent hole in the second rotating disc fully open the selected port; and an air pump assembly disposed in the main body, the air pump assembly operable in an inflation state in which the air pump assembly directs air to the selected port to inflate the corresponding chamber of the inflatable product and a deflation state in which the air pump assembly directs air from the selected port to deflate the corresponding chamber of the inflatable product.

14. The air assembly of claim 13, the air pump assembly comprising a unidirectional impeller having an inlet and an outlet, the air assembly further comprising a directional control valve, wherein:

in the inflation state, the directional control valve directs air from a surrounding environment to the inlet of the impeller; and in the deflation state, the direction control valve directs air from the selected port to the inlet of the impeller.

15. The air assembly of claim 13, the channel switching mechanism further comprising a motor with a rotating shaft that rotates the first rotating disc, wherein the motor, the first rotating disc, and the second rotating disc are axially stacked together in the direction of the rotating shaft.

16. The air assembly of claim 15, wherein the second rotating disc selectively rotates with the first rotating disc such that:

forward rotation of the first rotating disc is transferred to the second rotating disc; and reverse rotation of the first rotating disc after the forward rotation is independent of the second rotating disc.

17. The air assembly of claim 13, wherein the air pump assembly is activated when the channel switching mechanism is in the second state and before the channel switching mechanism is in the third state.

18. A multichannel air assembly for use with an inflatable product having at least two chambers, the air assembly comprising:

a main body forming a main body chamber with an opening, the main body comprising at least two ports in respective communication with the at least two chambers;

a main body panel covering the opening of the main body;

a control panel coupled to the main body panel and comprising a vent and a control key operably connected to a circuit board;

an air pump assembly disposed in the main body chamber, the air pump assembly comprising:
a pump cover comprising an air inlet;
a pump body cooperating with the pump cover to form an impeller chamber;
an impeller disposed in the impeller chamber; and
a pump motor comprising a rotating shaft disposed through the pump body and coupled to the impeller;
a directional control valve disposed in the main body chamber and comprising:
a first motor operably coupled to the circuit board; and
a switching component movably disposed between the pump cover and the main body panel to place the air inlet of the pump cover in selective communication with the main body chamber or the vent of the control panel, the switching component operably coupled to the first motor; and
a channel switching mechanism disposed in the main body chamber, the channel switching mechanism comprising:
a second motor operably coupled to the circuit board, the second motor comprising a rotating shaft;
a first rotating disc fixedly coupled to the rotating shaft and comprising a third vent in communication with the main body chamber; and
a second rotating disc configured to selectively rotate with the first rotating disc, the second rotating disc comprising a fourth vent in selective communication with the at least two ports and the third vent of the first rotating disc.

19. The air assembly of claim 18, the directional control valve further comprising a first sensor in communication with the switching component, and the channel switching mechanism further comprising a second sensor in communication with the first rotating disc and the second rotating disc, wherein both the first sensor and the second sensor are operably coupled to the circuit board.

20. The air assembly of claim 18, the second rotating disc comprising an arc-shaped groove and the first rotating disc comprising a boss, wherein the arc-shaped groove receives the boss and allows the boss to move within the arc-shaped groove.

21. The air assembly of claim 19, further comprising an upper cover coupled to a sidewall of the main body, the upper cover supporting the pump motor.

22. The air assembly of claim 21, wherein the first rotating disc and the second rotating disc each comprise at least one sensed block configured for detection by the second sensor.

23. The air assembly of claim 21, wherein the switching component comprises a gear disc operably coupled to a rotating shaft of the first motor and a translating valve having a rack, the gear disc engaging the rack, and the translating valve comprising a fifth vent, a sixth vent, and a seventh vent in selective communication with the vent of the control panel and the impeller chamber.

24. The air assembly of claim 21, wherein the switching component comprises a driving gear disc operably coupled to a rotating shaft of the first motor and a driven gear disc engaged with the driving gear disc, the driven gear disc comprising a sensed block configured for detection by the first sensor and a first vent and a second vent, both the first vent and the second vent in selective communication with the vent of the control panel and the pump body chamber.

25. The air assembly of claim 24, wherein the first vent comprises a first opening on an upper end face of the driven gear disc and a second opening on a lower end face of the driven gear disc; and the second vent comprises a first opening on the lower end face of the driven gear disc and a second opening on a sidewall of the driven gear disc.

26. The air assembly of claim 23, wherein the sixth vent is disposed between the fifth vent and the seventh vent; a first opening of the fifth vent is located on an upper end face of the translating valve; a second opening of the fifth vent is located on a lower end face of the translating valve; a first opening of the seventh vent is located on the upper end face of the translating valve; a second opening of the seventh vent is located on a lower end of the translating valve; a first opening of the sixth vent is located on the lower end face of the translating valve; and a second opening of the sixth vent is located on a side end face of the translating valve.

27. The air assembly of claim 25, wherein a cover plate is disposed between the translating valve and the pump cover, the cover plate comprising an eighth vent in communication with the air inlet of the pump cover and a ninth vent in communication with the air outlet of the pump cover.

28. A multichannel air assembly for use with an inflatable product having at least a first chamber and a second chamber, the air assembly comprising:
a main body forming a main body chamber and further comprising a first vent in communication with a surrounding environment, a first port in communication with the first chamber, and a second port in communication with the second chamber;
a control coupled to the main body;
a channel selector disposed in the main body and operably coupled to the control, the channel selector configured to place the main body chamber in selective communication with a selected one of the first and second ports; and
an air pump assembly disposed in the main body in communication with the first vent, the air pump assembly operable in:
an inflation state in which the air pump assembly directs air from the surrounding environment to the selected port to inflate the corresponding chamber of the inflatable product; and
a deflation state in which the air pump assembly directs air from the selected port to the surrounding environment to deflate the corresponding chamber of the inflatable product;
the air pump assembly comprising:
a pump body;
a pump cover cooperating with the pump body to form an impeller chamber;
an impeller disposed in the impeller chamber;
an air pump motor coupled to the impeller; and
a directional control valve that directs air from the surrounding environment to an inlet of the impeller in the inflation state and directs air from the selected port to the inlet of the impeller in the deflation state, wherein the impeller chamber communicates with the first vent and the main body chamber.

29. The air assembly of claim 28, further comprising a panel coupled to the main body to cover an opening in the main body, wherein the panel defines the first vent and supports the control.

30. The air assembly of claim 28, wherein the channel selector is a rotating disc.

31. The air assembly of claim 28, wherein the air pump motor is disposed through the pump body such that the air pump motor is positioned below the pump body and the impeller is positioned above the pump body.

32. The air assembly of claim 28, wherein the pump cover defines an inlet vent and an outlet vent.

33. The air assembly of claim 32, wherein the directional control valve further comprises a first fluid duct in communication with the first vent, a second fluid duct in communication with the inlet vent, and a third fluid duct in communication with the outlet vent.

* * * * *